US007768207B2

(12) United States Patent
Allen et al.

(10) Patent No.: US 7,768,207 B2
(45) Date of Patent: Aug. 3, 2010

(54) HIGHLY EMISSIVE MATERIAL, STRUCTURE MADE FROM HIGHLY EMISSIVE MATERIAL, AND METHOD OF MAKING THE SAME

(75) Inventors: Gary R. Allen, Chesterland, OH (US); Deeder Aurongzeb, Mayfield Heights, OH (US)

(73) Assignee: General Electric Company, Schenectady, NY (US)

( * ) Notice: Subject to any disclaimer, the term of this patent is extended or adjusted under 35 U.S.C. 154(b) by 234 days.

(21) Appl. No.: 11/871,657

(22) Filed: Oct. 12, 2007

(65) Prior Publication Data

US 2009/0096342 A1 Apr. 16, 2009

(51) Int. Cl.
*H01J 17/16* (2006.01)

(52) U.S. Cl. ..... 313/635; 313/493

(58) Field of Classification Search ..... 313/493, 313/634–636

See application file for complete search history.

(56) References Cited

U.S. PATENT DOCUMENTS 3,586,898 A * 6/1971 Speros et al. ..... 313/635
4,870,672 A 9/1989 Lindberg
5,470,222 A 11/1995 Holowczak et al.
6,084,352 A 7/2000 Seki et al.
6,391,383 B1 5/2002 Matsunaga et al.
2006/0226777 A1 10/2006 Cunningham
2007/0149674 A1 6/2007 Kim et al.

OTHER PUBLICATIONS

Lin, et al., "Optical properties of ITO/$AlO_x$ thin films prepared by reactive d.c. magnetron sputtering," *Ceramics International*, Elsevier Ltd. and Techna S.r.l., v.29 (2003), pp. 771-776.

* cited by examiner

*Primary Examiner*—Vip Patel
(74) *Attorney, Agent, or Firm*—Fay Sharpe LLP

(57) ABSTRACT

The invention relates to a high temperature material modified to exhibit enhanced IR emittance in the wavelength range where a black body operating at the same high temperature exhibits peak emittance, to a light-transmissive body comprising the high temperature material, to a high intensity lamp comprising the high temperature material, and to a method of preparing the same.

16 Claims, 18 Drawing Sheets

FIGURE 13

| 100W PCA Arctube example | | | |
|---|---|---|---|
| | ITO coating with 0.5 emittance | | |
| Standard Arctube | PCA Arctube with same Dimensions | PCA Arctube at same Temperature | |
| 100 | 100 | 100 | AT Watts |
| 0.70 | 0.70 | **0.62** | AT Diam [cm] |
| 1.00 | 1.00 | **0.89** | AT Length [cm] |
| 1.43 | 1.43 | 1.43 | Aspect Ratio |
| 2.20 | 2.20 | 1.74 | AT Surface Area [cm^2] |
| 45 | 45 | 58 | Wall Load [W/cm^2] |
| 40 | 40 | 40 | Power Dissipation at Wall |
| 1300 | **1033** | 1300 | AT Wall Temp [K] |
| **0.20** | **0.50** | **0.50** | PCA AT hemi emit |
| 7 | 7 | 14 | Prad [W] |
| 33 | 33 | 26 | Pcond+conv |

HIGHLY EMISSIVE MATERIAL, STRUCTURE MADE FROM HIGHLY EMISSIVE MATERIAL, AND METHOD OF MAKING THE SAME

CROSS-REFERENCE TO RELATED APPLICATION

Filed on even date herewith is related application entitled HIGHLY EMISSIVE MATERIAL, STRUCTURE MADE FROM HIGHLY EMISSIVE MATERIAL, AND METHOD OF MAKING THE SAME (Ser. No. 11/871,624) to our common assignee.

BACKGROUND OF THE INVENTION

The present invention relates to high temperature materials exhibiting enhanced infra red emittance. It finds particular application in those instances where the material is used in high intensity electric discharge lamps, and more particularly in those instances where the lamp comprises a ceramic metal halide arc tube. However, it is to be appreciated that the present disclosure will have wide application for materials, for example glass and ceramic materials, that benefit from thermal management of high temperature operation, for instance throughout the lighting industry.

BRIEF DESCRIPTION OF THE INVENTION

Materials for which the present disclosure may prove suitable include any material characterized by a temperature of operation that is high enough that thermal radiation capability is a significant factor in the design of articles constructed from the material. One such use of a high temperature material according to the invention is in a lamp envelope for use at high operating temperatures, in excess generally of 500° K. While the invention will be described hereafter with regard to use of the material for lighting applications, it is to be understood that the physical and performance characteristics and parameters of the material are equally applicable to other applications that would benefit from use of a material that demonstrates enhanced emittance. Such additional high temperature applications may include, but are in no way intended to be limited to, glass, fused silica, or ceramic containers such as crucibles or other material processing articles; any article that is heated internally and must dissipate its heat externally, such as combustion chambers, electronic components, chemical, biological, or nuclear reactors; articles that need to be cooled quickly from high temperatures; and other applications where an enhanced ability to dissipate heat from a hot object is advantageous.

With regard to lighting industry applications, lamps for which the present disclosure may prove suitable include any lamp characterized by an envelope whose temperature is high enough that thermal radiation from the envelope is significant in the design of the lamp, typically exceeding about 500° K., hereinafter a "high temperature" lamp. An exemplary lamp benefiting from this disclosure is characterized by an envelope of ceramic containing a discharge-supporting filling of gas or vapor, for example. The exemplary lamp includes at least one pair of electrodes with a gap between which an electric discharge passes in operation of the lamp, but it may also be an electrodeless lamp. A conventional lamp of this construction might have, on average, a gap length ranging from 2 mm to 60 mm and a diameter ranging from 1 mm to 30 mm. In addition to the foregoing, another exemplary lamp application includes use of the material disclosed herein for fused silica metal halide lamps.

Conventional high intensity discharge (HID) lamp technology can be limited for some applications by high temperature operation. In the past, HID lamps have been constructed using fused silica or ceramic envelopes when using metal halides, and ceramic envelopes for high pressure sodium discharge lamps. While the foregoing materials are acceptable for more rudimentary applications, they tend to fail quickly under extreme operating conditions, i.e., very high thermal loading resulting in very high operating temperature or high stresses, or both. There is a need, therefore, for envelope materials that are not susceptible to the envelope degradation that can be caused when running a lamp at very high temperature, i.e., in excess of 500° K. By providing an enhanced thermal management, this invention allows for a highly loaded lamp to operate at significantly lower temperature or stress, or both; or alternatively the highly loaded lamp may be designed with smaller dimensions while operating at the same temperature as the larger lamp, allowing for miniaturization of the lamp. Such materials will be instantly applicable in markets including, but not limited to, indoor retail lighting including big box retail venues, outdoor architecture lighting, road and industrial application lighting, theater, arena and stadium lighting, and many other types of applications. As is readily appreciated by one skilled in the art, these types of applications involve extended use, which would cause a conventional lamp to run hotter than its materials allow and to fail more quickly. In addition, the material will find application in other articles that would benefit from the opportunity to construct the article to demonstrate longer life or smaller size features, based on the ability of the material to emit heat energy more efficiently.

A high temperature, visible light-transmissive material modified to exhibit enhanced IR emittance in the wavelength range where a black body operating at the same high temperature exhibits peak emittance is provided.

In addition, a visible light-transmissive body comprising a high temperature material modified to exhibit enhanced IR emittance in the wavelength where a black body operating at the same temperature exhibits peak emittance is also provided.

Also provided is a high intensity lamp comprising a visible light-transmissive arc tube, wherein the arc tube comprises a high temperature material modified to exhibit enhanced IR emittance in the wavelength where a black body operating at the same temperature exhibits peak emittance.

Still further provided is a method for cooling a lamp envelope during lamp operation comprising coating a surface of the lamp envelope with an oxide coating, supplying the lamp with an increased power loading, operating the lamp; and maintaining a reduced operating temperature by externally emitting heat energy generated by the lamp in the form of infrared radiation

BRIEF DESCRIPTION OF THE DRAWINGS

FIG. 13 is a table of the impact of an ITO coating on the temperature and dimensions of a typical PCA CMH arctube.

DETAILED DESCRIPTION OF THE INVENTION

Figure 1:
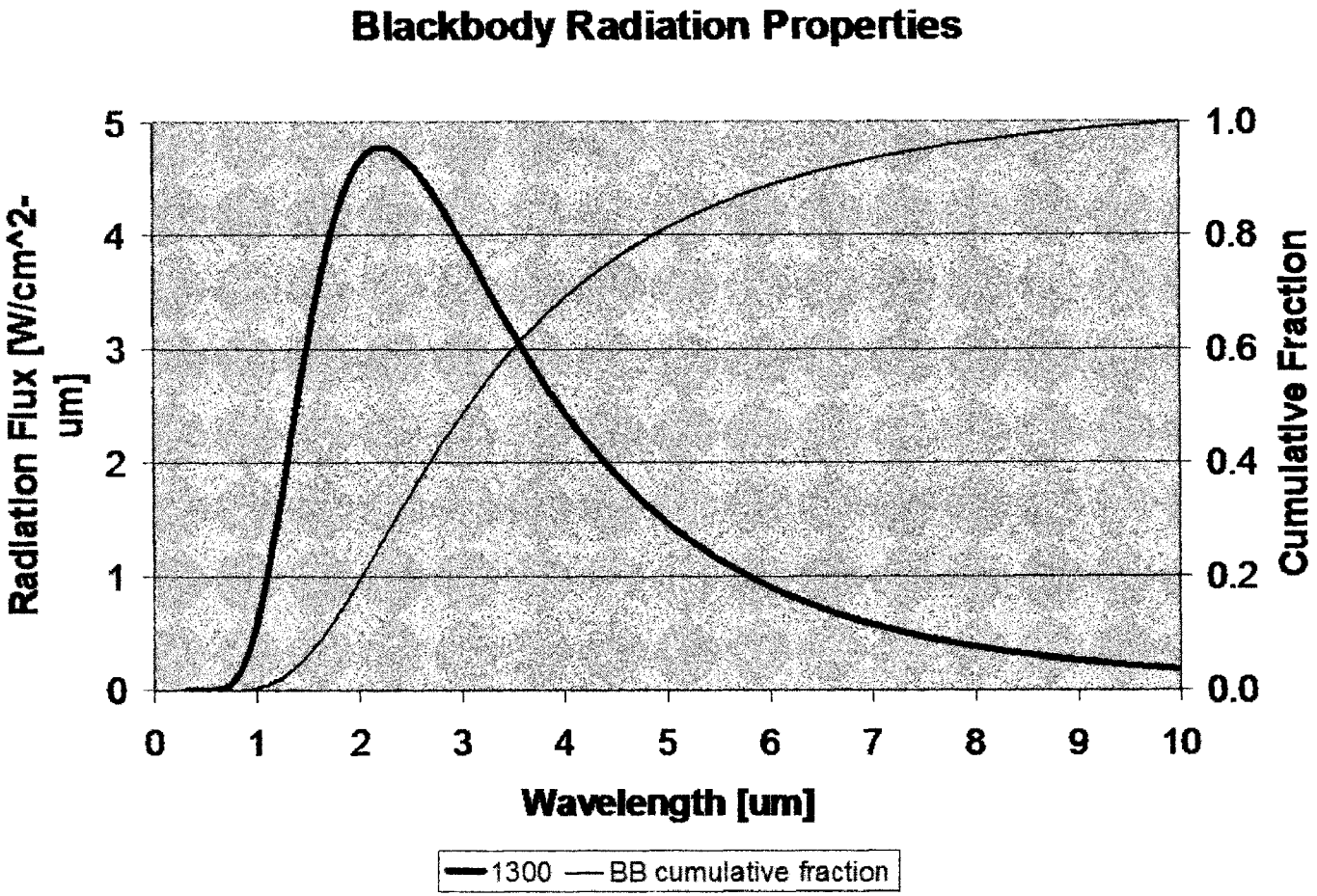
FIG. 1 is a graph of the radiation flux emitted by a blackbody, and the cumulative fraction, as a function of wavelength at a temperature of 1300K.

Visible light-transmissive high temperature materials exhibiting enhanced IR emittance are disclosed. The materials may be applied to many high operating temperature applications. One such application is in the lighting industry, particularly for high intensity lamps. While the invention will be discussed hereinafter with regard to the lighting industry, this is done merely to better exemplify the attributes of materials according to the invention. This application is not, however, intended to be limitative of the applications for the inventive material. Those performance benefits illustrated in the following disclosure with regard to lamp technology are believed to be indicative of the benefit of the material to other high temperature applications. Such additional high temperature applications may include, but are in no way intended to be limited to, glass, fused silica, or ceramic containers such as crucibles or other material processing articles; any article that is heated internally and must dissipate its heat externally, such as combustion chambers, electronic components, chemical, biological, or nuclear reactors; articles that need to be cooled quickly from high temperatures; and other applications where an enhanced ability to dissipate heat from a hot object is advantageous.

High intensity lamps, for example high intensity discharge lamps, HIDs, may be used for many applications requiring extended running or operational time and having a need for brighter, better color quality lighting. Conventionally, HID lamp envelopes have been constructed from fused silica or ceramic. Current applications of interest require materials that are more tolerant of higher wall loading, or power dissipated in the envelope per unit surface area of the envelope. To achieve a quality lamp subjected to higher wall loading, without experiencing early lamp failure, the lamp envelope contemplated herein is constructed from polycrystalline alumina (PCA). Other applications for PCA substrates that may benefit from the invention disclosed herein include, but are not limited to, glass, fused silica, or ceramic containers such as crucibles or other material processing articles; any article that is heated internally and must dissipate its heat externally, such as combustion chambers, electronic components, chemical, biological, or nuclear reactors; articles that need to be cooled quickly from high temperatures; and other applications where an enhanced ability to dissipate heat from a hot object is advantageous.

PCA is a polycrystalline form of sapphire, characterized by its single crystal nature. The elemental composition of the material, $Al_2O_3$, provides increased high temperature capability. Therefore, lamps that were previously constructed from fused silica can now be made using the PCA material disclosed herein, resulting in lamps that run hotter and more efficiently, without concerns for envelope degradation. In addition, lamps having a PCA lamp envelope exhibit light output with enhanced color quality.

Many HID lamp applications, such as theater lighting, headlamps, sports lighting, and any lamp forming a beam of light, for example, are benefited by a lamp having a smaller, more compact size. With the use of PCA as described herein as an envelope material, an arc tube dissipating up to about 400 W electrical power can be as small as one and one half inches long. This more compact lamp construction, having high power wattage, has obvious benefits over known, more conventional fluorescent lighting which generally is constructed as, for example, a four foot long arc tube dissipating only 30 W electrical power. For example, the brightness of a lamp in accord with the invention is several orders of magnitude higher than the most comparable fluorescent lamp, and at least an order of magnitude higher than that generated by incandescent or halogen lamps that might be considered comparable in other respects.

Added to the foregoing size features of a lamp constructed with a PCA envelope in accord with the disclosure is the increased life of the lamp. Because the envelope material is not susceptible to early degradation from high operating temperatures or other operational characteristics, lamps having the PCA envelope of the invention will experience longer life than might otherwise be expected.

Therefore, the enhanced features of the current lamp, including but not limited to long life, increased efficiency, compact construction, and better light quality, make the lamp suitable for many applications, including but not limited to indoor retail lighting including big box retail venues, outdoor architecture lighting, headlamps, road and industrial application lighting, theater, arena and stadium lighting, and many other types of applications.

In one embodiment, a lamp having compact construction coupled with equivalent or even enhanced lamp life, as compared to potentially viable alternatives, is constructed. This is accomplished by tailoring the thermal properties of the arc tube material, i.e., by enhanced thermal management of the lamp. More specifically, the PCA arc tube material, which exhibits superior high temperature operating capability as compared to fused silica, is further enhanced with regard to the arc tube material whose radiative heat transfer is dominant relative to its convective heat transfer, thus rendering the material "radiation dominated" as defined more fully hereafter. In effect, the material emits infrared radiation that would otherwise be retained within the lamp, causing premature lamp failure at higher running temperatures over increased periods of time, and especially in smaller lamp configurations.

Without intending to be bound by any specific theory, it is believed that fused silica, PCA, and other ceramics and glasses may be made to be radiation dominated based on the following. For example, an arc tube intended for use in the applications set forth hereinabove, including indoor retail lighting including big box retail venues, outdoor architecture lighting, headlamp, road and industrial application lighting, theater, arena and stadium lighting, and other high temperature types of applications, may generally run at about 1200-1400° K. By nature, a material operating at this high heat intensity will try to radiate away or dissipate excess heat. If the material were able to radiate with the maximum theoretical efficiency, then its thermal radiation would have the spectral output of a blackbody, as seen in FIG. 1. For a lamp envelope constructed from this material and operating at 1300° K, the thermal radiation would generate a peak at 2.2 microns, which falls within the infrared (IR) region of light emissions. Visible light emits at about 0.40 micron to about 0.75 micron. Wavelengths longer than about 0.75 micron are generally considered to be in the infrared spectral region.

Materials have a characteristic referred to as "emissivity", and structures comprised of the material are characterized by "emittance", which represents the capability of the material or the structure to radiate thermal power as compared to the maximum theoretical capability of a blackbody under the same conditions.

A "blackbody" is known in the art to represent an object that absorbs all electromagnetic radiation that falls onto it; because the object neither allows radiation to pass through it nor reflects it, it is an ideal absorber and an ideal source of thermal radiation. Therefore, the amount and wavelength of radiation this object emits is directly related to the temperature of the object. Below about 700° K. (430° C.), such objects produce little if any visible light, while perfectly absorbing all light, and appear black, hence the name "blackbody".

Figure 2:
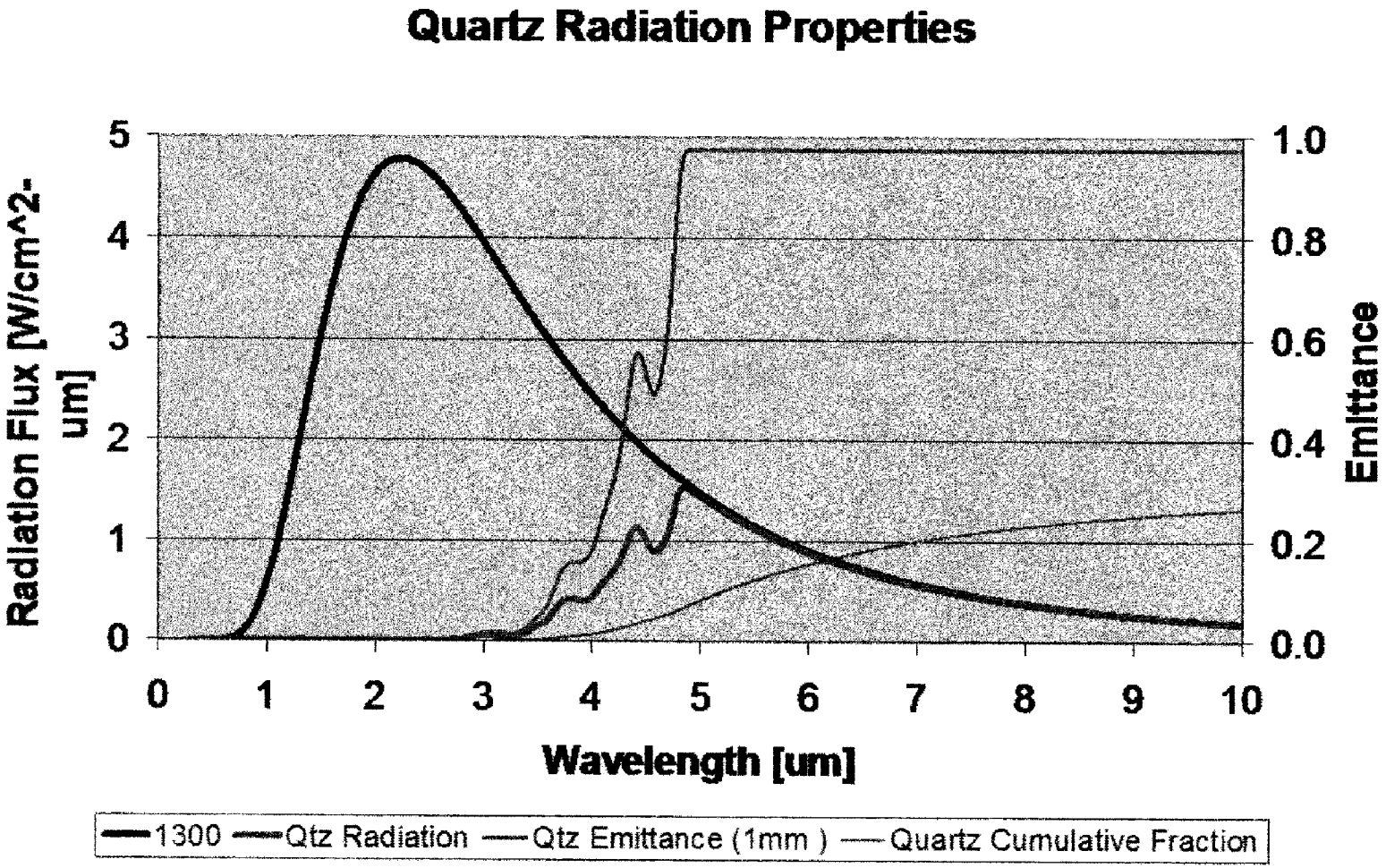
FIG. 2 is a graph comparing the radiation flux emitted by a blackbody with the emittance and radiation flux emitted by fused silica, and the cumulative fraction, as a function of wavelength; and the total hemispherical emittance at a temperature of 1300K.

The emittance of a typical fused silica tube with a 1 mm thick envelope wall is shown in FIG. 2. By integrating the product of the fused silica emittance and the blackbody flux over all wavelengths, and dividing by the integral of the blackbody flux, the effective total hemispherical emittance of the fused silica is found to be 0.26, meaning that the fused silica tube radiates its own thermal power with an efficiency equal to 26% of that of an ideal blackbody at 1300° K. Equation (1) provides the formula for the intensity of the Radiation Flux of the Blackbody as a function of wavelength and temperature, as represented in FIG. 2:

$$E_{b\lambda} = \frac{C_1\lambda^{-5}}{e^{C_2/\lambda T} - 1} \tag{1}$$

Wherein:

$C_1 = 3.743\times10^8\ W\cdot\mu^4/m^2$ $C_2 = 1.4387\times10^4\ \mu\cdot K$ $\lambda$=wavelength, $\mu$ T=temperature, ° K.

Figure 3:
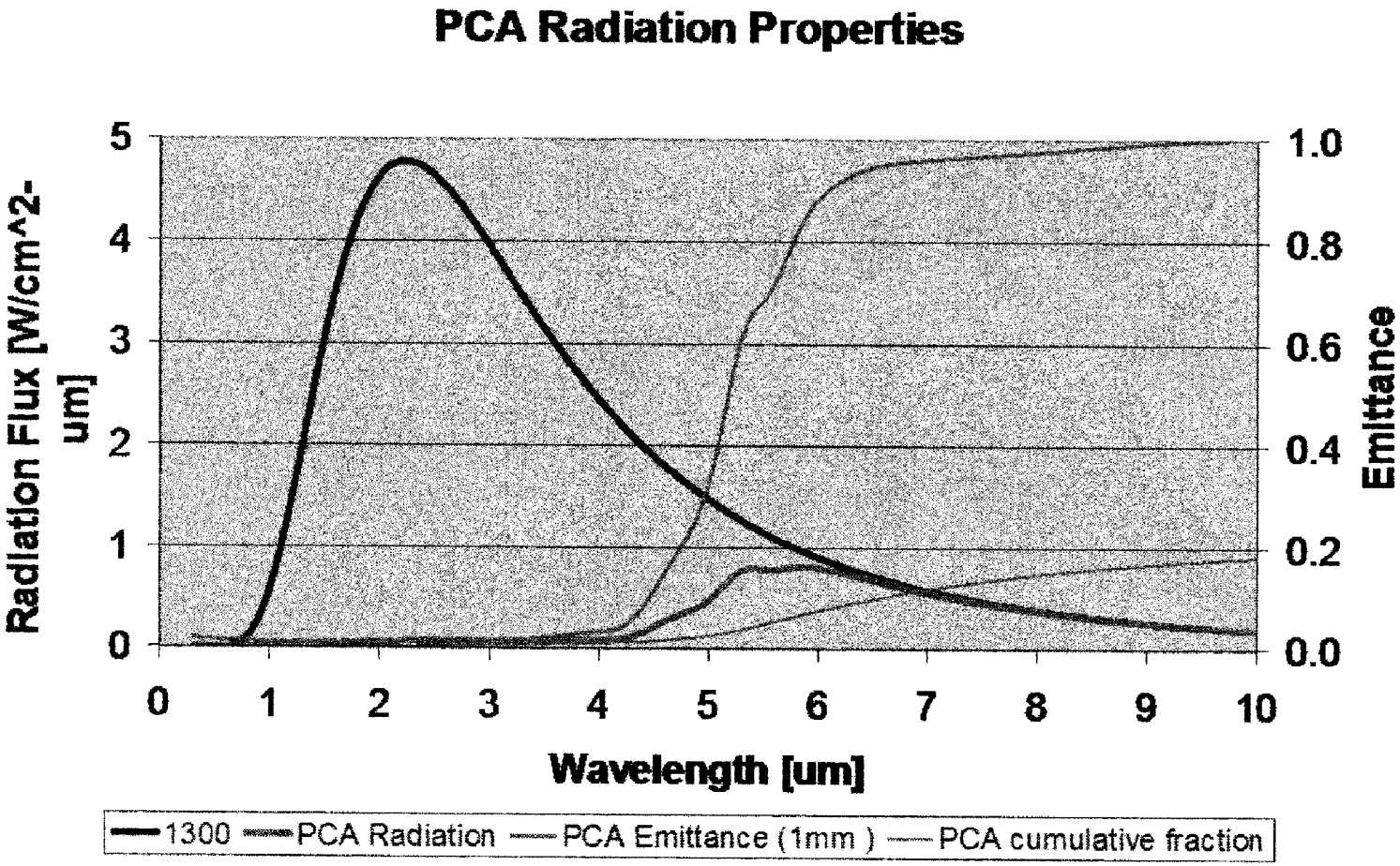
FIG. 3 is a graph comparing the radiation flux emitted by a blackbody with the emittance and radiation flux emitted by Polycrystalline Alumina (PCA), and the cumulative fraction, as a function of wavelength; and the total hemispherical emittance at a temperature of 1300K.

The emittance of a typical PCA tube with a 1 mm thick envelope wall is shown in FIG. 3. By integrating the product of the PCA emittance and the blackbody flux over all wavelengths, and dividing by the integral of the blackbody flux, the effective total hemispherical emittance of the PCA is found to be 0.18, meaning that the PCA tube radiates its own thermal power with an efficiency equal to 18% of that of an ideal blackbody at 1300° K.

The reason for these low radiation efficiencies of the fused silica and PCA tubes is the mismatch between the peak of the blackbody curve, which occurs at 2.2 μm at 1300° K., and the onset of significant emissivity of the fused silica and PCA materials at wavelengths longer than 4 or 5 μm, respectively. At the longer wavelengths where the fused silica and PCA materials are able to radiate thermal energy, the intrinsic thermal content of the blackbody is reduced, whereas at the peak of the blackbody radiation spectrum the fused silica and PCA materials are incapable of radiating. Consequently, about 80% of the lamp's capability to radiate excess heat away is unused, leaving the heat energy within the lamp envelope. Fused silica and PCA materials, and particularly arctubes, therefore, do not naturally operate anywhere close to their theoretical optimal temperatures at a given wall loading. Other glass and ceramic materials typically used for lamp envelopes and other high-temperature applications have similar emissivities at a given wavelength and suffer the same inability to cool themselves efficiently at high temperatures, above about 500° K.

The term "high temperature" as used herein refers to temperatures in excess of 500° K. within the context of this invention. This determination is based on the following. The impact of the enhancement of the IR emittance of a material or object becomes significant only at sufficiently "high temperature" such that the heat transfer by radiation from the material or object is non-negligible compared with conducted and convected heat transfer from the material or object. The temperature at which radiation becomes significant, i.e., is non-negligible, can be estimated by calculating the power dissipated by each of the heat transfer mechanisms from a typical object.

A typical example of a heated object which could benefit from this invention could be represented as a hollow cylindrical envelope, heated from the inside e.g. by a light source, or a combustion process or other chemical process, which is cooled by heat transfer to the ambient atmosphere. Notwithstanding the foregoing, if the heated object exhibits another geometric shape, and the heat source is from some other location, the principles of heat transfer, and increasing the IR emittance, would still be similarly beneficial.

If the heat transfer from the heated solid object by thermal conduction along the solid object to some heat sink is not dominant, then the total power dissipated from such a heated object is approximated by equation (2):

$$P_{diss}=P_{cond+conv}+P_{rad}=hA(T_{wall}-T_{amb})+\epsilon\sigma A(T_{wall}^4-T_{amb}^4) \quad (2)$$

Where h=coefficient of convection [W/cm$^{-2}$-K];

A=outside surface area of the object [cm$^{-2}$];

$T_{wall}$=average temperature of the outside surface of the object [K];

$T_{amb}$=average temperature of the ambient air or other fluid surrounding the object [K];

$\epsilon$=total hemispherical emittance of the object at its operating temperatures $\sigma$=Stefan-Boltzmann constant=$5.6705\times10^{-5}$ erg-cm$^{-2}$/K$^4$-sec.

In a typical example of a hollow cylindrical envelope enclosing a light source, if there is for example 100 W of power supplied to the light source, and if about 30 W is radiated as visible light and about 30 W is dissipated by thermal conduction axially along the solid ends of the envelope, then an amount of power, $P_{diss}$=40 W, must be dissipated by radiation and convection from the heated cylinder to the ambient. In the lighting industry, such a cylindrical envelope, or lamp, might typically have an outside surface area of about A=5 cm$^2$. If the lamp is operating in ambient air without forced convection, with the axis of the cylindrical envelope in a horizontal orientation, then the convection coefficient is about h=15. If the envelope material is poly-crystalline alumina (PCA), or yttria-alumina garnet (YAG), or fused silica (quartz), or glass, or other high-temperature, light-transmitting material, then the emittance at a temperature of about 1000° K. is typically about $\epsilon$=0.2.

The example lamp envelope, or other heated object, will attain a temperature of the envelope such that the heat transferred to the ambient by radiation and convection from the object equals the power dissipated in the object during operation of the lamp. The same is true for other sources of heat, such as combustion, chemical reaction, or other processes.

Figure 4:
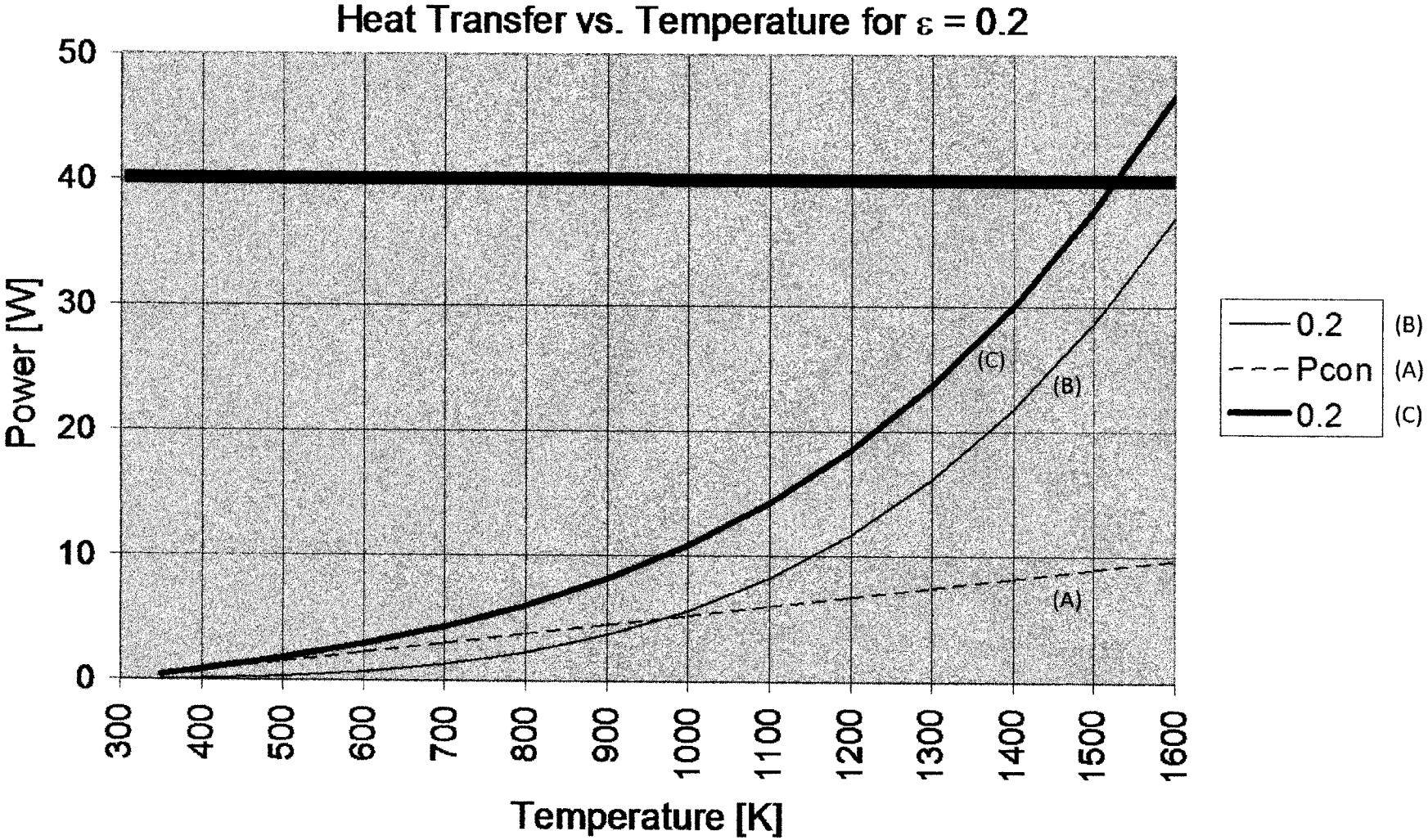
FIG. 4 is a graph of the dissipated power of a heated object having 0.2 emittance as a function of temperature.

In the plot in FIG. 4, the thin dashed line (A) shows the power transferred by convection, with h=15, from the heated object to the ambient air as a function of the temperature of the heated object. The thin solid line (B) is the power transferred by radiation, with $\epsilon$=0.2, from the heated object to the ambient. This is representative of the radiated power from a PCA object, or other lamp envelope, or similar high-temperature object. The thick solid line (C) is the sum of the convection and radiation power. In equilibrium operation, the heated object will attain a temperature where the level of the thick solid line equals the power dissipated in the heated object, which in this example is 40 W. Therefore, this object would attain an equilibrium operating temperature of about 1520° K.

In this example, for an object with an emittance of about 0.2, at temperatures above about 970° K, or about 700° C., the radiated power exceeds the convected power. Furthermore, at temperatures above about 500° K., the radiated power of an object with an emittance of about 0.2 exceeds about 20% of the convected power, so that the contribution to the total power dissipation from radiation is significant. Any temperature above about 500° K. can therefore be considered to be high-temperature in this invention for an object having an emittance of about 0.2, which is typical of light-transmitting ceramics, glasses, and fused silica.

Similarly, an object with an emittance different from about 0.2 can be considered to be high-temperature as defined herein, for temperatures above which the radiated power of the object exceeds about 20% of the convected power. Table I below demonstrates a few such examples. For an object with an emittance of about 0.1 or 0.3 or 0.5, the object may be considered to be high-temperature as defined herein if the effective average temperature of the object exceeds about 700° K. or about 400° K. or about 350° K., respectively. For example, at an emittance of 0.1, $P_{rad}$ (0.66) does not exceed 20% of $P_{con}$ (3.00) until about 700° K.

TABLE I

| | Emittance | | | | | | h |
|---|---|---|---|---|---|---|---|
| | 0.1 | 0.2 | 0.3 | 0.5 | 0.7 | 1 | 0.0015 |
| $T_{wall}$ | $P_{rad}$ | $P_{rad}$ | $P_{rad}$ | $P_{rad}$ | $P_{rad}$ | $P_{rad}$ | $P_{con}$ |
| 350 | 0.02 | 0.04 | 0.06 | 0.10 | 0.14 | 0.20 | 0.38 |
| 400 | 0.05 | 0.10 | 0.15 | 0.25 | 0.35 | 0.50 | 0.75 |
| 500 | 0.15 | 0.31 | 0.46 | 0.77 | 1.08 | 1.54 | 1.50 |
| 600 | 0.34 | 0.69 | 1.03 | 1.72 | 2.41 | 3.44 | 2.25 |
| 700 | 0.66 | 1.32 | 1.97 | 3.29 | 4.60 | 6.58 | 3.00 |

Figure 5:
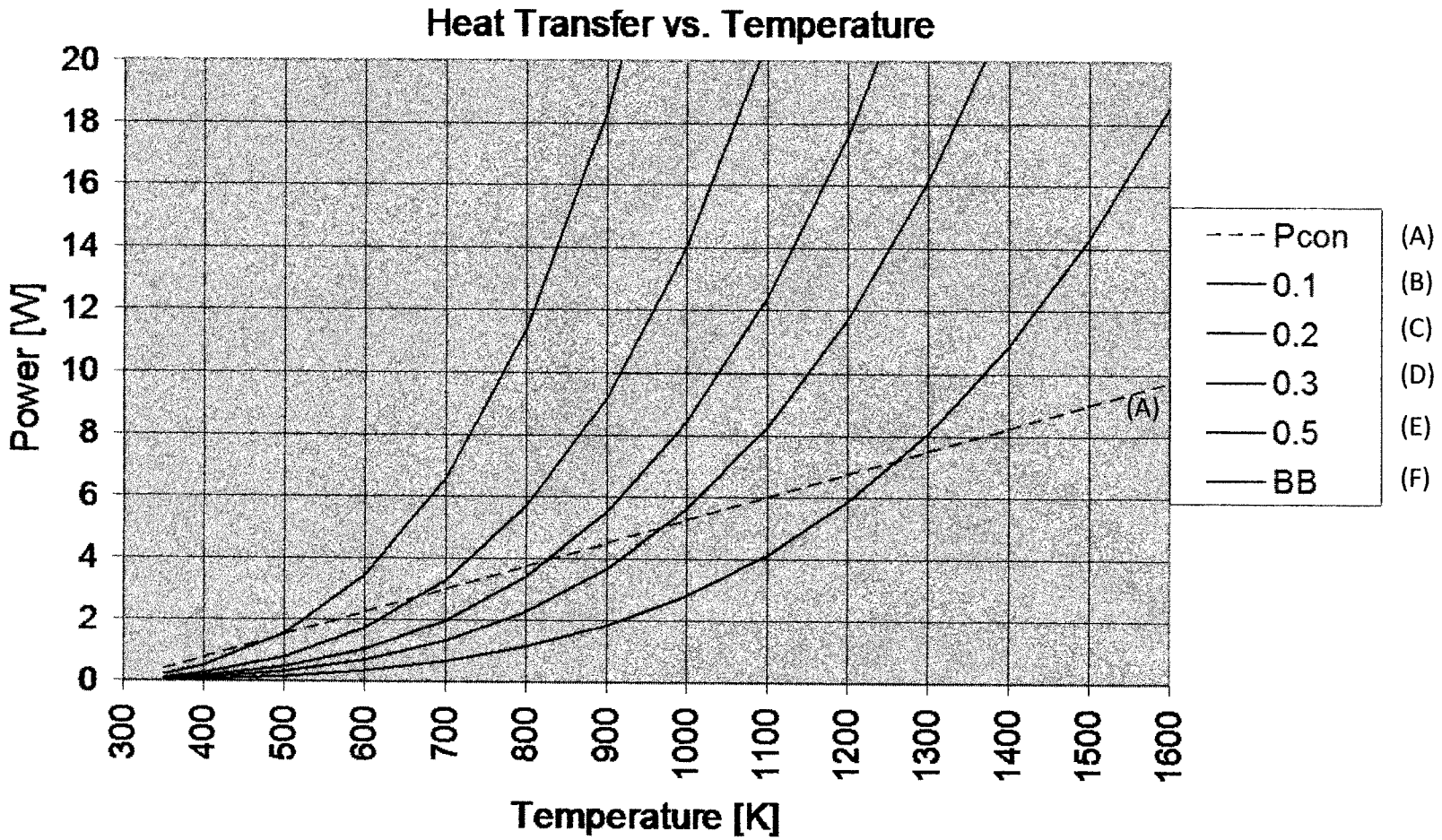
FIG. 5 is a graph of the dissipated power of a heated blackbody object as a function of temperature.

As used herein, the term "radiation dominated" means a high-temperature object whose radiative heat transfer is dominant relative to its convective heat transfer. To better exemplify this term, with reference to FIG. 5, the plot shows, in the thin dashed line (A), the power transferred by convection from a heated object with h=15 to the ambient air as a function of the temperature of the heated object. The thin solid lines correspond to the power transferred by radiation from a heated object to the ambient, with $\epsilon$=0.1 (B), 0.2 (C), 0.3 (D), 0.5 (E), and 1.0 (F) (blackbody).

As previously defined, when this ratio exceeds about 20%, the object can be considered to be high-temperature, indicating that radiative heat transfer is significant. Furthermore, when this ratio exceeds 100%, then the radiative contribution to the total heat transfer will have a dominant impact on the temperature of the object. This is the case at temperatures greater than about 500° K. for an ideal blackbody object, or about 980° K. for an object with emittance of about 0.2. Such a high-temperature object, whose radiative heat transfer is dominant relative to convective heat transfer, is referred to herein as "radiation dominated". For a radiation-dominated heated object, the IR emittance has a very significant effect on the total heat transfer, and thereby on the design temperature and the design size of the object. Notwithstanding the foregoing, any increase in the emissive capability of a visible light-transmissive, high temperature substrate or material offers design and use advantages.

Any temperature above about 980° K. (about 700° C.) can therefore be considered to be radiation dominated for an object having an emittance of about 0.2, which is typical of visible light-transmitting ceramics, glasses, and fused silica.

Figure 6:
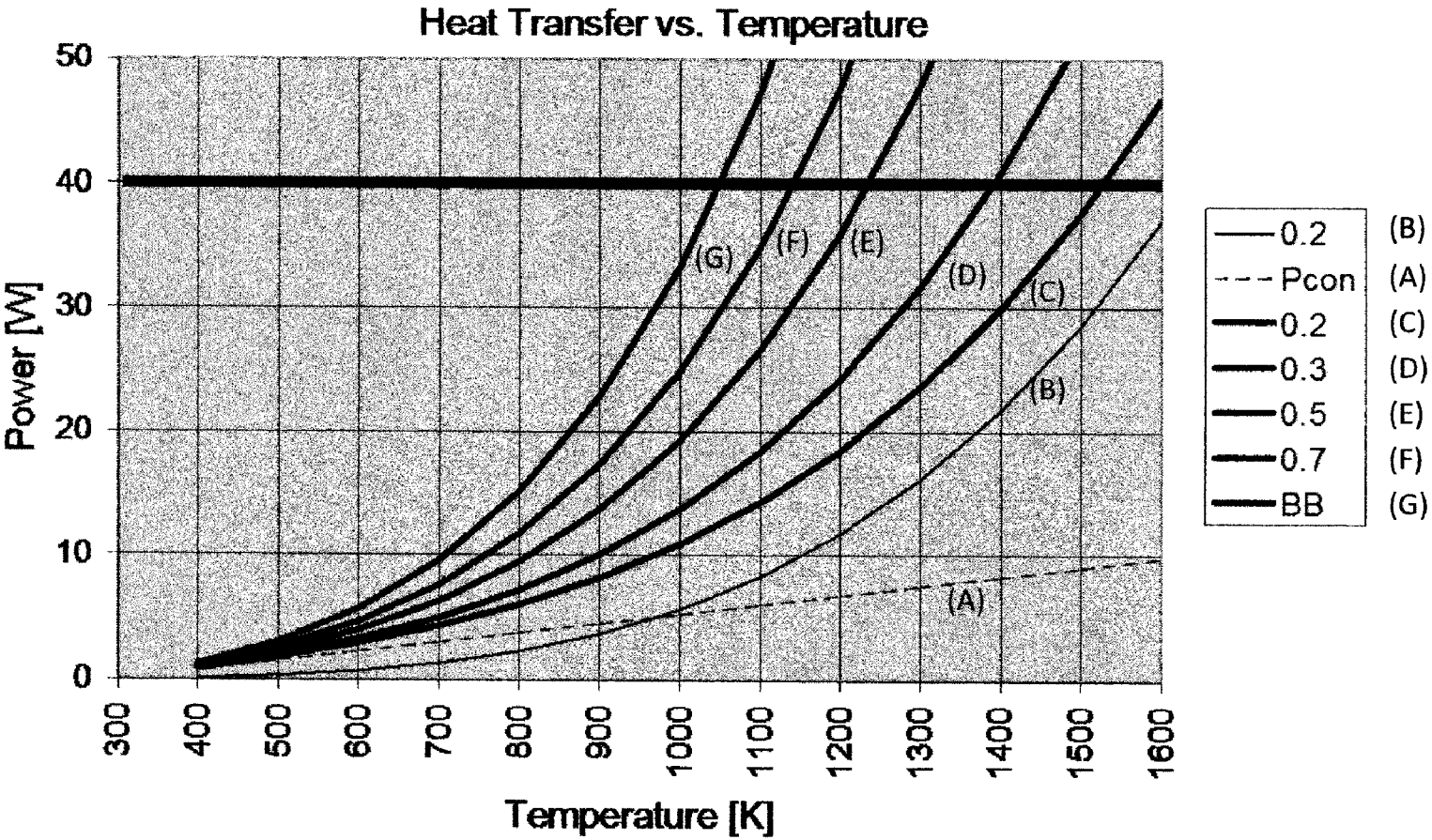
FIG. 6 is a graph of the dissipated power of a heated object as a function of temperature.

In addition to the foregoing, temperature can be reduced by increasing IR emittance at constant area, A. For example, the thin dashed line (A) in FIG. 6 corresponds to the power transferred by convection, with h=15, from a heated object to the ambient air as a function of the temperature of the heated object. The heated object is the same size (A=5 cm$^2$) at each temperature. The thin solid line (B) represents the power transferred by radiation, with $\epsilon$=0.2, from the heated object to the ambient. There are five thick solid lines (C, D, E, F, G) shown which are the sum of the convection and radiation power at 5 different emittance levels, i.e., 0.2 (C), 0.3 (D), 0.5 (E), 0.7 (F), and 1.0 (G) (1.0=Blackbody).

Figure 7:
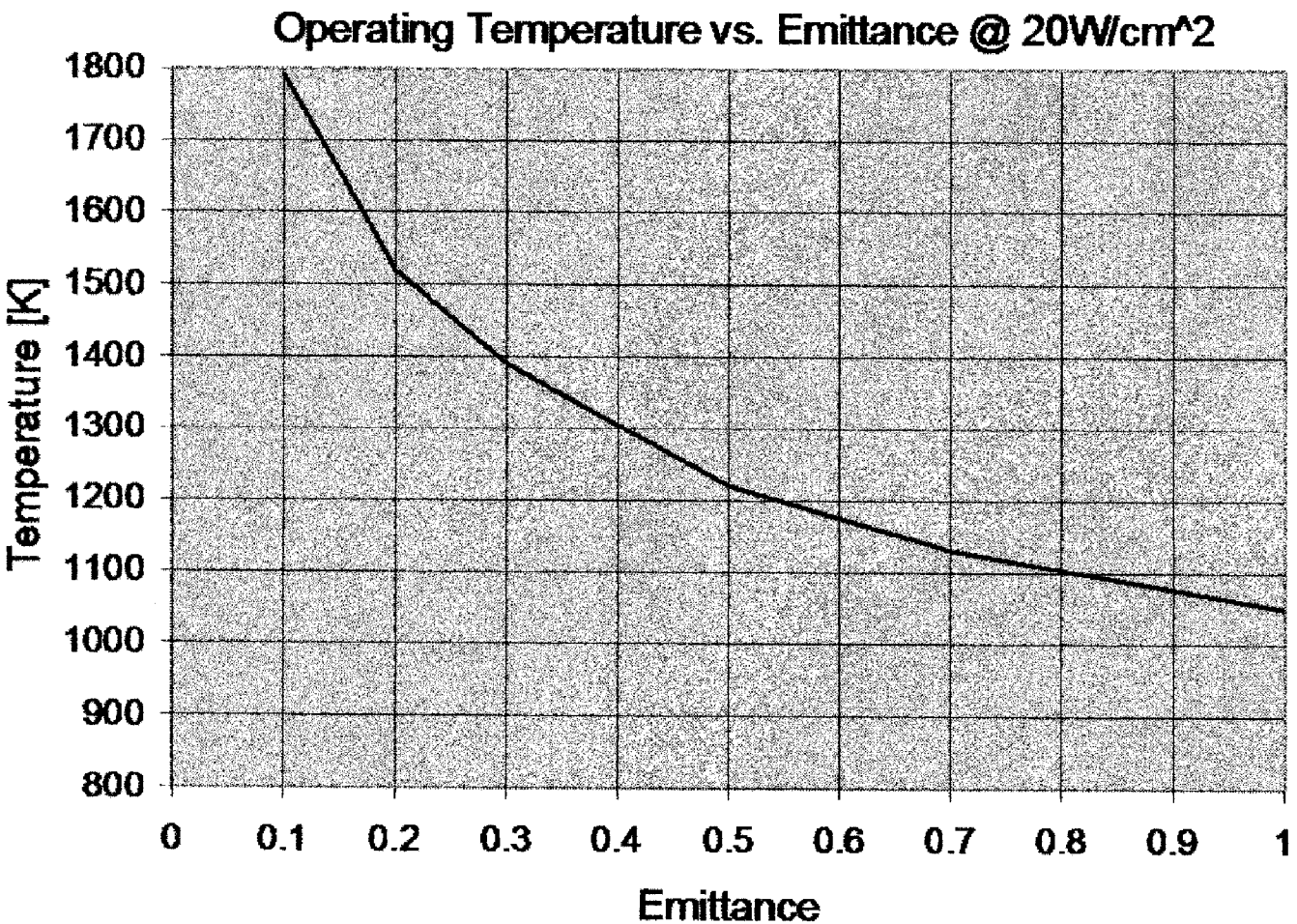
FIG. 7 is a graph of a reduction in operating temperature as a function of emittance.

In equilibrium operation, the heated object will attain a temperature where the level of each thick solid line, depending on the emittance of the object, equals the power dissipated in the heated object, which in this example is 40 W. So, this object would attain an equilibrium operating temperature of about 1520° K. for $\epsilon$=0.2 (C); about 1390° K. for $\epsilon$=0.3 (D); about 1220° K. for $\epsilon$=0.5 (E); about 1130° K. for $\epsilon$=0.7 (F); and about 1050° K. for $\epsilon$=1.0 (G) (blackbody limit). This reduction of operating temperature vs. emittance is shown in the plot in FIG. 7.

Therefore, even a modest increase in the emittance from 0.2 to 0.3 can provide a temperature reduction of about 130° K., whereas a significant increase in emittance from 0.2 to about 0.7 can provide a temperature reduction of about 390° K. A temperature reduction of about 50° K. or more can greatly improve the lifetime and reliability of heated objects.

Figure 8:
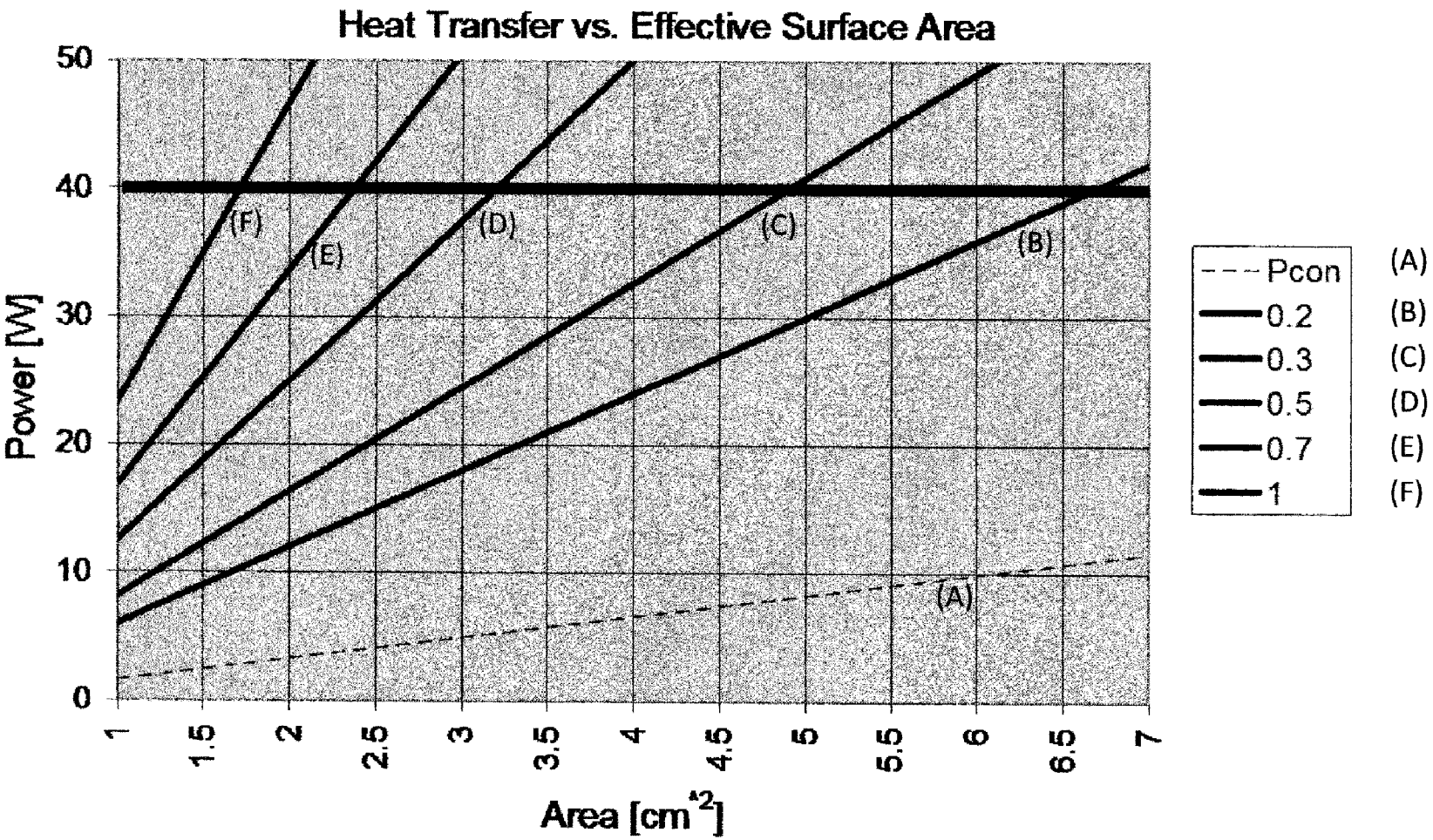
FIG. 8 is a graph of the dissipated power of a heated object as a function of surface area.
Figure 9:
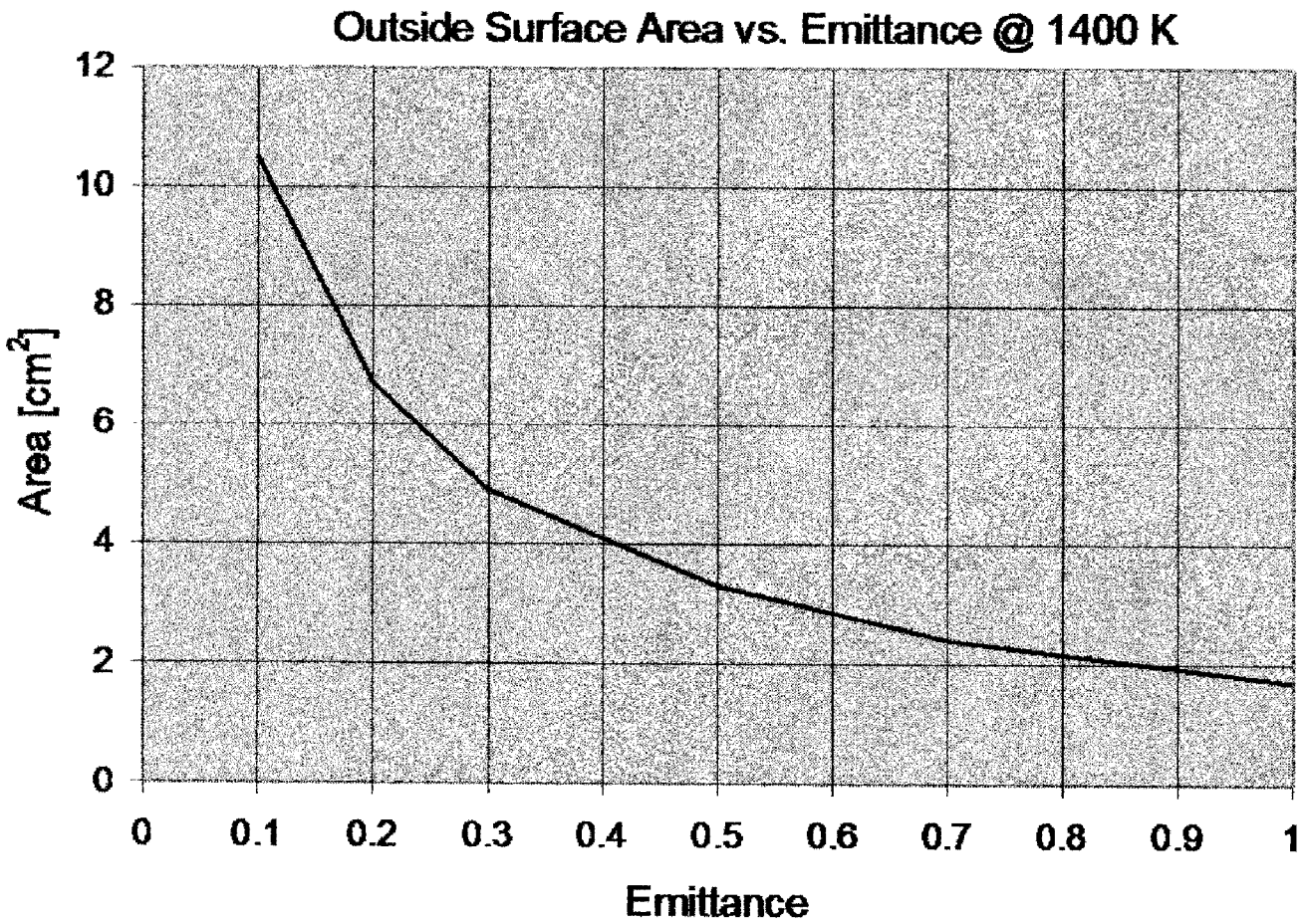
FIG. 9 is a graph of the reduction in outside surface area as a function of emittance.

One can also then predict the impact on area, A, of increasing IR emittance at constant temperature T. With reference to the plot in FIG. 8, the thin dashed line (A) represents the power transferred by convection, with h=15, from the heated object to the ambient air as a function of the outside surface area of the heated object. The heated object has the same temperature ($T_{wall}$=1400° K), independent of area. In this plot, there are five thick solid lines (B, C, D, E, F) corresponding to the sum of the convection and radiation power at 5 different emittance levels, i.e., at 0.2 (B), 0.3 (C), 0.5 (D), 0.7 (E), and 1.0 (F) (1.0=Blackbody). In equilibrium operation, a heated object with a certain outside surface area will attain the desired temperature, i.e., 1400° K., where the level of each thick solid line equals the power dissipated in the heated object, which in this example is 40 W. Therefore, the object would attain an equilibrium operating temperature of about 1400° K. if its area is A=6.7 $cm^2$, for $\epsilon$=0.2 (B); or if its area is A=4.9 $cm^2$, for $\epsilon$=0.3 (C); or if its area is A=3.3 $cm^2$, for $\epsilon$=0.5 (D); or if its area is A=2.4 $cm^2$, for $\epsilon$=0.7 (E); or if its area is A=1.7 $cm^2$, for $\epsilon$=1.0 (F) (blackbody limit). This reduction of outside surface area vs. emittance is shown in the plot in FIG. 9.

Based on the foregoing, even a modest increase in the emittance from 0.2 to 0.3 can allow for a 27% reduction in effective radiation surface area (from 6.7 to 4.9 $cm^2$) of the object at a constant temperature of 1400° K. Furthermore, a more significant increase in emittance from 0.2 to about 0.7 can allow for a 64% reduction in effective radiation surface area of the object at a constant temperature of 1400° K. Since the linear dimensions of the heated object will generally scale in proportion to the square root of the effective surface area for radiation, the linear dimensions of the heated object at constant temperature can be reduced by 14% and 40% for increases in the emittance from 0.2 to 0.3 or to 0.7, respectively. Reductions of linear dimensions exceeding about 5% or area dimensions exceeding about 10% can greatly improve the performance, flexibility, and cost of certain heated objects. For example, if the heated object is the ceramic PCA envelope of a light source, and the effective surface area of the envelope is reduced by 27% or 64%, then visible brightness of the light source will be increased by 37% or 170%, respectively, at constant temperature, which generally equates to constant lifetime.

The ability to increase the capacity of visible light-transmissive material, particularly a lamp envelope material to radiate away excess heat energy more efficiently provides a desirable operational advantage. For example, being able to enhance PCA, such that it operates at greater than about 20% emissivity, would greatly enhance lamp performance and lamp life. As is noted, PCA naturally radiates away excess heat energy only beyond about 5 μm in the IR region.

The enhanced PCA envelope, in accord with this invention, however, exhibits improved emissivity and operating temperature, providing needed options to lamp manufacturers for many lamp applications. In one embodiment, a lamp in keeping with current size parameters but exhibiting longer operating life due to increased emissivity and reduced temperature and stress is constructed. In another embodiment, a lamp of much smaller dimensions providing higher brightness or a more compact illuminator, but that will exhibit operating life comparable with larger more conventionally sized lamps and illuminators is constructed.

In light of the foregoing disclosure regarding material limitations with respect to emittance, temperature and size, in order to achieve the foregoing options, the lamp envelope material must be enhanced to improve performance to the desired levels. A lamp envelope having a visible light-transmissive coating in accord with that described herein, that allows the lamp to emit radiant heat at shorter wavelengths, thereby increasing its emittance up to about 50% or more of its theoretical maximum, is provided.

Figure 10:
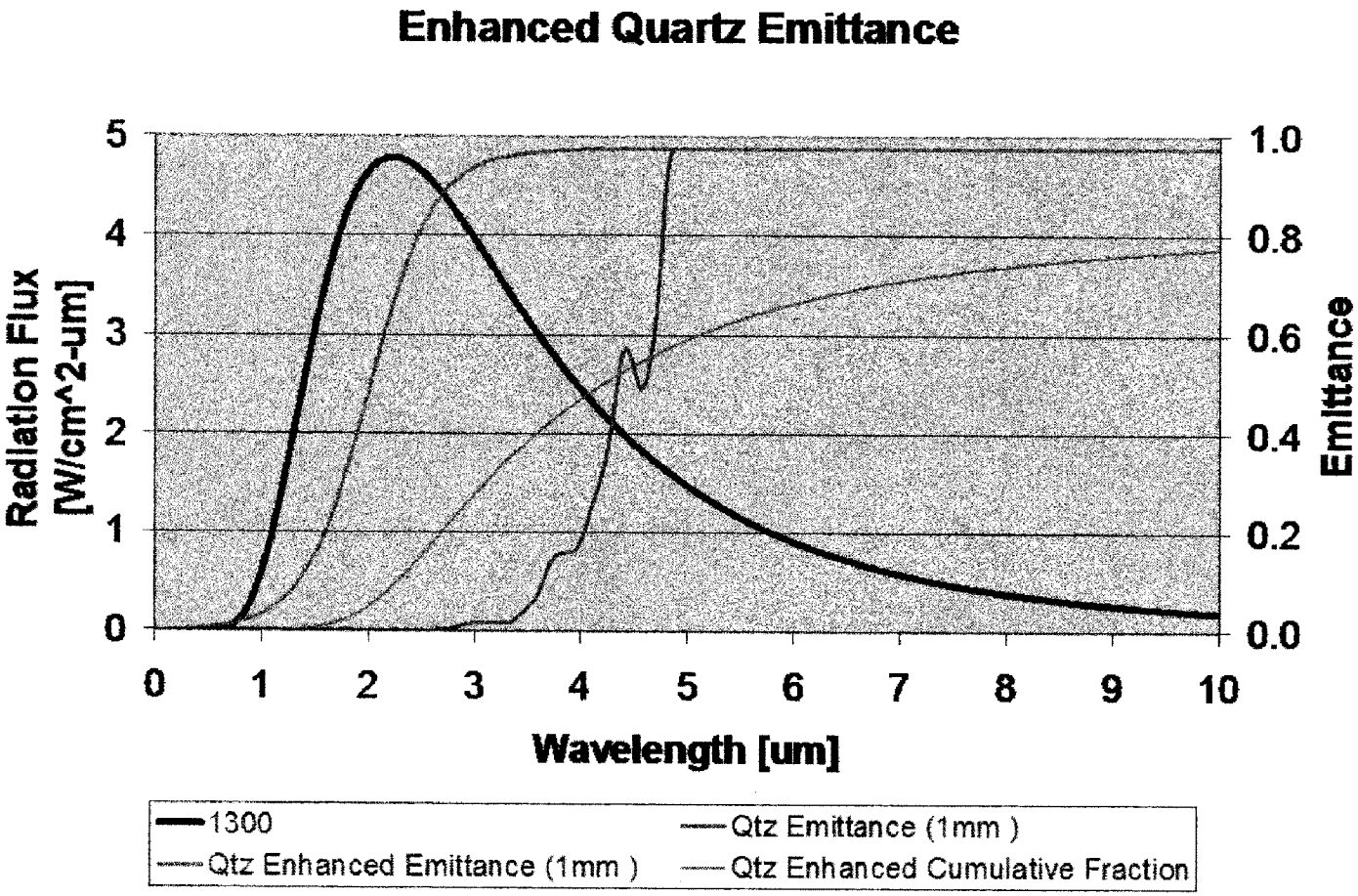
FIG. 10 is a graph comparing the radiation flux emitted by a blackbody with the emittance and radiation flux emitted by theoretically enhanced fused silica, and the cumulative fraction, as a function of wavelength; and the total hemispherical emittance at a temperature of 1300K.

With regard to fused silica substrate material, the emittance of a fused silica tube with a 1 mm thick envelope wall is shown in FIG. 10, where the emittance has been theoretically enhanced at the shorter IR wavelengths such that the emittance at 2.0 μm is 50% with an idealized smooth transition vs. wavelength. By integrating the product of the enhanced fused silica emittance and the blackbody flux over all wavelengths, and dividing by the integral of the blackbody flux, the effective total hemispherical emittance of the theoretically enhanced fused silica is found to be 0.77, meaning that the enhanced fused silica tube radiates its own thermal power with an efficiency equal to 77% of that of an ideal blackbody at 1300° K.

Figure 11:
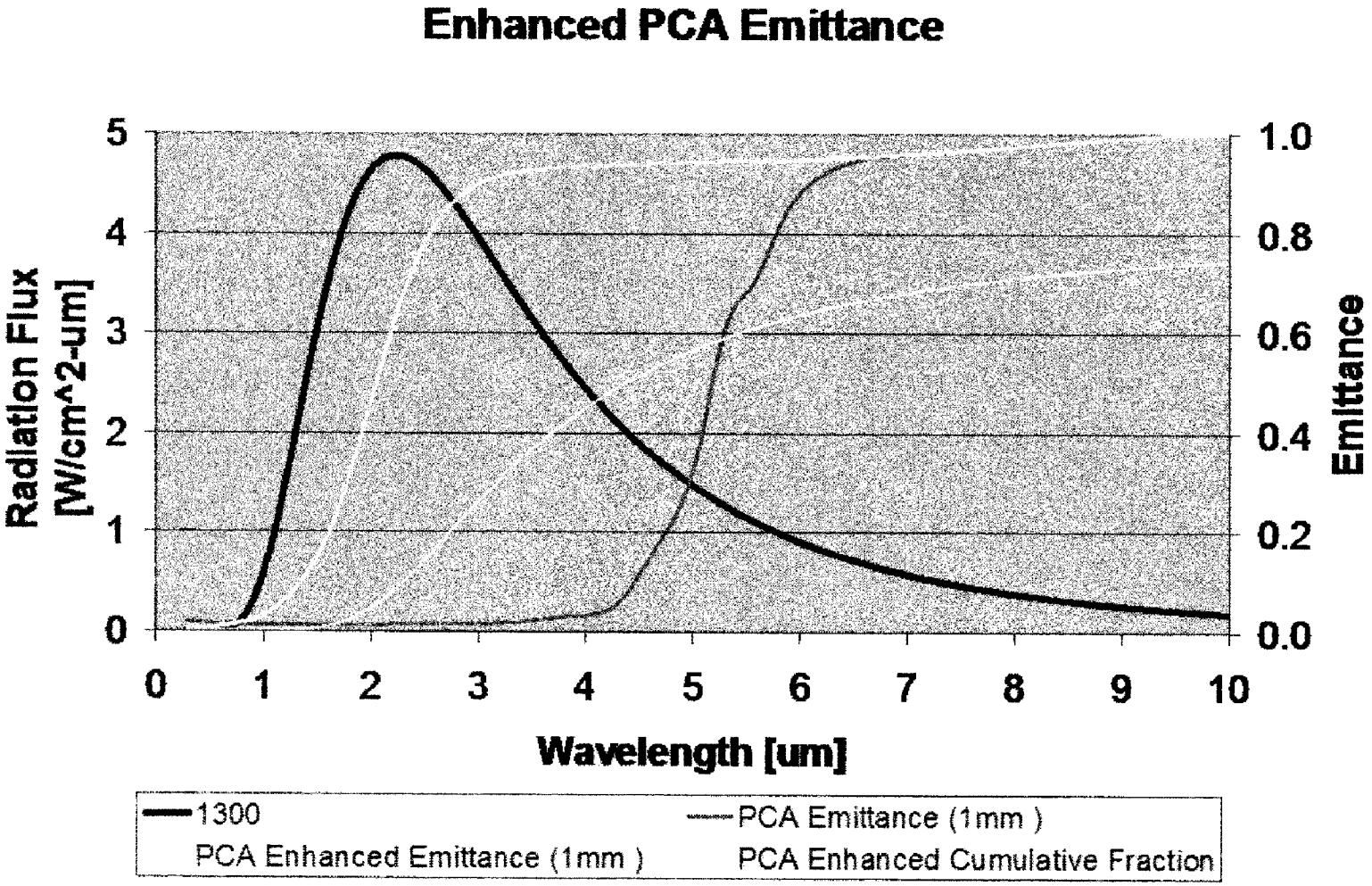
FIG. 11 is a graph comparing the radiation flux emitted by a blackbody with the emittance and radiation flux emitted by theoretically enhanced PCA, and the cumulative fraction, as a function of wavelength; and the total hemispherical emittance at a temperature of 1300K.

Similarly, the emittance of a PCA tube with a 1 mm thick envelope wall is shown in FIG. 11 where the emittance has been theoretically enhanced at the shorter IR wavelengths such that the emittance at 2.0 μm is 50% with an idealized smooth transition vs. wavelength. By integrating the product of the enhanced PCA emittance and the blackbody flux over all wavelengths, and dividing by the integral of the blackbody flux, the effective total hemispherical emittance of the theoretically enhanced PCA is found to be 0.75, meaning that the enhanced PCA tube radiates its own thermal power with an efficiency equal to 75% of that of an ideal blackbody at 1300° K., i.e. the PCA material is radiation dominated.

This demonstrates mathematically that a suitably tailored IR emittance modification can significantly enhance the ability of fused silica, PCA, or other material, to radiate away its own thermal load without reducing the ability of the material to transmit light in the visible region of the spectrum. Optimally, a coating used to achieve enhanced performance in keeping with that postulated in FIGS. 10 and 11, should enhance or tailor IR emittance such that it exhibits the largest possible value at about 2 μm and longer wavelengths, and further exhibits emittance reduced to about 0 at wavelengths shorter than about 0.75 μm so as to avoid absorption of visible light emitted by the lamp. Materials other than fused silica and PCA used for lamps and other high-temperature applications including, but not limited to, YAG, sapphire and glass would accrue similar thermal management benefits from such a modification of the IR emittance.

A coating comprised of indium-tin-oxide (ITO), for example, on a PCA substrate demonstrates the desired modification of IR emittance. In this embodiment, a coating of ITO results in enhanced emittance and reduced lamp temperature.

Figure 12:
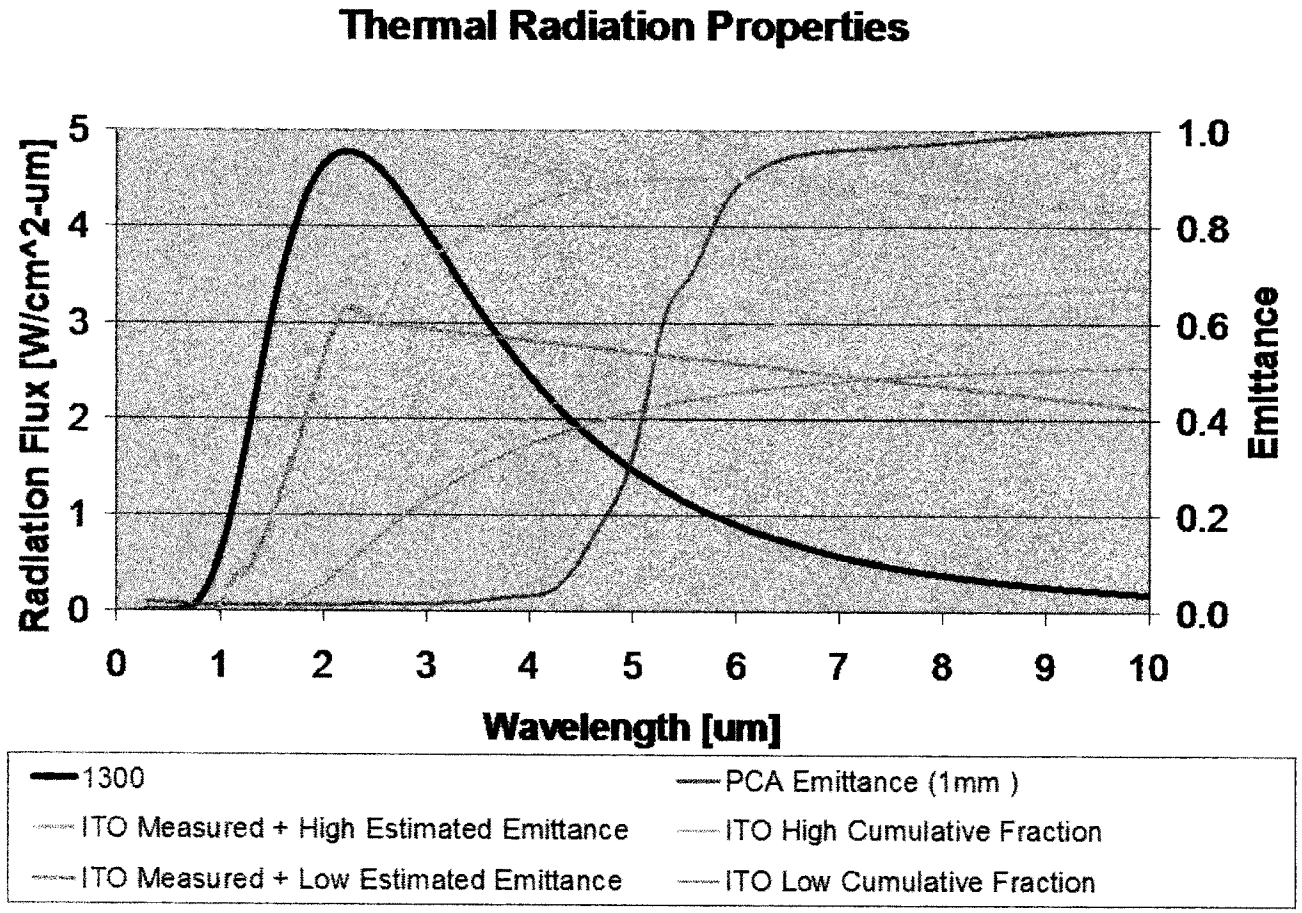
FIG. 12 is a graph comparing the radiation flux emitted by a blackbody with the emittance and radiation flux emitted by an actual ITO coating for PCA, and the cumulative fraction, as a function of wavelength; and the total hemispherical emittance at a temperature of 1300K.

The emittance of a PCA glass tube with a 1 mm thick envelope wall is shown in FIG. 12, where the emittance has been experimentally enhanced at the shorter IR wavelengths by addition of a coating of ITO to the glass substrate. The actual emittance has been measured over the range 0.3 to 2.5 μm. The emittance in the range 2.5 to 10.0 μm has been bracketed by a high-emittance estimate and a low-emittance estimate. By integrating the product of the enhanced PCA emittance and the blackbody flux over all wavelengths, and dividing by the integral of the blackbody flux, in accord with equation (1), the effective total hemispherical emittance of the ITO-enhanced glass is found to be in the range 0.51 to 0.68 using the high and low-emittance estimates beyond 2.5 μm along with the measured emittance in the 0.3 to 2.5 μm range, meaning that the ITO-coated PCA tube would radiate its own thermal power with an efficiency equal to 51% to 68% of that of an ideal blackbody at 1300° K.

The emittance of an object comprised of a substrate, for example glass, fused silica, PCA, YAG, sapphire, or other ceramic, and the ITO coating disclosed herein is substantially determined by the component, substrate or coating, that has the higher emittance at a given wavelength. At shorter IR wavelengths, where the substrate has low emittance, the combined structure has an emittance about equal to that of the coating, while at longer IR wavelengths where the substrate has higher emittance and the coating emittance may be declining, the structure has an emittance about equal to that of the substrate.

In another embodiment, the invention is comprised of a visible light-transmissive coating imparting enhanced IR emittance to a PCA envelope for a 400 W arc tube, i.e., 400 W of electrical power is delivered into the arc tube. The optimum result would be for all of the power from the 400 W of electricity delivered to the arc tube to be radiated in the form of visible light. As has been shown, however, a percentage of lamp power is lost to other than visible radiation, and often times a high percentage of power is lost, resulting in low efficiency lamp operation. For instance, a conventional HID lamp typically converts only 30% of its electrical power into visible light radiation. Additionally, depending on the specific type of HID lamp, about 10-20% of the lamp power may be radiated away from the lamp envelope in the UV and IR regions, and about 10-20% of the lamp power will be dissipated into the electrodes and end legs of the arctube if the lamp is so structured. Substantially all of the remaining power, about 30-50% of the available 400 W lamp power, is dissipated in the lamp envelope producing high temperatures and stresses that contribute to envelope degradation during lamp operation. Degradation resulting from excess heat energy retained within the lamp may come in many forms. The envelope itself may undergo melting, thus reducing lamp output and efficiency. The coil is another potential failure point; excessive heat may cause it to break or disintegrate. These are only exemplary of the many ways excess heat may cause lamp failure.

The fact that up to 70%-80% of the power of a 400 W lamp, i.e. 280-320 W is not radiated as visible light creates certain design constraints. The lamp must be large enough in size to effectively absorb the power that is not radiated without experiencing envelope degradation and premature lamp failure. However, this must be balanced with the need to create smaller physical lamps for certain applications that give the same operational life characteristics as their larger counterparts. The focus of this disclosure is, therefore, to decrease lamp size while maintaining operating life. An alternative is to use the subject technology to retain lamp size and extend operational life of the lamp. While that aspect is not fully discussed herein, it will be well within the skill of one in the industry to apply the teachings herein to achieve that result.

In another embodiment, the novel visible light-transmissive material and coating combination of the invention are used to create lamps having smaller sizes that exhibit equal or even better life than their larger counterparts. With a smaller lamp size, the HID arc tube more closely resembles a point source allowing for better light beam control. With the ability to control the light beam more effectively, there is less need for large reflectors. In all, the entire optical system can be produced more economically, and in a smaller and more easily handled package.

For example, the coated PCA, used in HID lamp applications, achieves the desired size and lamp life parameters by allowing the lamp to operate at higher running temperatures without experiencing any of the disadvantages of running hotter. This is accomplished by the PCA coating causing increased emissivity and lower running temperatures as a greater amount of the heat energy generated by the lamp is radiated away from the lamp, i.e., the lamp runs cooler.

In yet another embodiment, the invention is discussed with reference to use of an emittance-enhanced visible light-transmissive coating in keeping with the disclosure as applied to a typical CMH lamp operating at 100 W. Some design and performance parameters for such a lamp are shown in FIG. 13. All parameter values are approximate for a typical 100 W CMH arctube. The standard arctube dimensions are approximately 0.7 cm ID, 1.0 cm length. With regard to an uncoated lamp, the lamp has a typical power balance such that approximately 40% of the lamp power, or 40 W, is dissipated into the bulb portion of the lamp envelope. With an approximate total hemispherical emittance of 0.20, if the arctube is designed to operate at a temperature of 1300° K. in the bulb portion of the envelope, then the envelope will radiate approximately 7 W of power by thermal radiation from the envelope material. The remaining 33 W of power, of the total 40 W dissipated into the envelope, is transferred to the ambient by conduction and convection losses.

By comparison, if the same arctube is coated with an IR emittance-enhancing visible light-transmissive coating to achieve total hemispherical emittance equal to 0.50, then the temperature of the bulb portion of the envelope will be reduced from 1300° K. to about 1033° K., a reduction of 267° K. In another comparison if the arctube with an IR emittance-enhanced visible light-transmissive coating is redesigned with smaller dimensions to achieve the original envelope temperature of 1300° K., then the linear dimensions of the envelope will be reduced by 11%, e.g. the radius will be reduced from 0.7 cm to 0.62 cm and the length will be reduced from 1.00 cm to 0.89 cm. Reduction of the linear dimensions of the bulb portion of the arctube envelope, while maintaining the same temperature, provides for the same light generation from a smaller light source, i.e. the light source is smaller and brighter, providing better beam control and more compact luminaries.

An additional benefit of smaller dimensions in the bulb portion is a significant reduction in convection of the high pressure gas that is typically used inside an operating HID lamp. The power dissipated in the envelope wall due to convection of the heated gas inside the bulb portion typically scales as the $4^{th}$ power of the inside diameter of the arctube. In the example of FIG. 13, the envelope diameter is reduced to 0.89 times the original diameter, so that the power dissipation due to convection might be reduced to $(0.89)^4$, or 0.63 of the original, thereby potentially reducing the temperature difference between the top and the bottom of the arctube by a comparable amount. This more isothermal temperature distribution typically results in more stable performance of the lamp relative to its orientation during operation, and also typically reduces the stress in the envelope which is proportional to temperature differences in the envelope. Therefore, the addition of an emittance-enhancing coating that allows for a smaller arctube operating at a temperature comparable to a larger, uncoated arctube typically will provide for a smaller, brighter light source, with better beam control and smaller, lighter, less-expensive luminaire, as well as potentially longer life due to reduced stress.

Turning now to an actual PCA envelope coated with the inventive coating disclosed herein, the invention is described with reference to a particular application, though given the foregoing, one skilled in the art will understand how use of the coating may be applied to other substrates to achieve enhanced performance. The visible light-transmissive coating may be an oxide of, for example, tin, indium, zinc, aluminum, zirconium, hafnium, tungsten, lanthanum, lutetium, and silicon, or any oxide having a melting point greater than 1300° C. The oxides may be used in combination to gain specific performance advantages, i.e. to increase the range of emissivity. When adding a coating to a PCA lamp envelope, use of an oxide-based coating is advantageous given that the PCA, i.e., polycrystalline alumina or aluminum oxide, is itself an oxide material, thus enhancing adaptability of the coating to the substrate. In general, the coating may be applied to the envelope by, for example, sputtering, chemical vapor deposition techniques, or others.

One alternative to use of a coating to modify the substrate is to mix or combine the substrate material with an oxide source as disclosed immediately above. The same or comparable performance advantages can be achieved in this manner.

With reference back to FIG. 11, PCA exhibits standard emittance peaking at about 5.5 μm. The total hemispherical emittance for uncoated PCA is shown to be 0.18 or 18% of a blackbody at 1300° K. Use of an oxide coating on the PCA envelope, however, functions to broaden the peak for, and thereby increase the emissivity of, the PCA substrate material. In fact, enhanced emittance is shown to increase up to 75% of the blackbody theoretical value at 1300° K.

In yet another embodiment, the visible light-transmissive coating can be doped to further enhance emission performance of the PCA envelope. For example, an oxide coating of the type already shown may be further doped with a material exhibiting a melting point of at least 1300° C. such as aluminum, indium, zinc, tin, hafnium, chromium, silicon, carbon, zirconium, tungsten, lanthanum, strontium, beryllium, and borides and boronitrides thereof, and nitrides and oxynitrides thereof. These dopants are generally admixed with the coating in their elemental form. Generally, the coating is doped with a dopant comprising an element other than the predominant metal of the oxide coating. Each of these potential dopants, as well as the coating materials, has a characteristic emissivity. The combining of materials may produce a coating exhibiting an overlap of emissive properties, which increases efficiency, or the combination may achieve an additive effect, depending on the materials combined. For example, indium oxide emits at 1.9 microns while zinc oxide emits at 2.3 microns. Combination of these oxides, then, renders an emission spectra for the coating that is broader than either material alone might generate. Any number of materials may be used in combination to tailor the emission spectra for the lamp to which the resulting combination coating is applied.

The coating, whether comprising a single material or a composite of several oxides, is preferably deposited in a single layer. This layer is generally from about 10 nm to about 2 micron thick. The use of a single layer of material has advantages over known multiple layer techniques given that in the high operating temperature applications for which the lamps of the current invention are intended multi-layer coatings tend to collapse and degrade, potentially causing operating problems and eventual lamp failure. Therefore, a further advantage of the coating is that it can be applied in a single layer. However, it is feasible to deposit the coating of the invention in multiple layers, as determined by lamp configuration, coating content, and intended application, and achieve the same or similar performance benefits.

Another advantage of the invention is the high melting point of the coating composition. Whether the coating comprises a single oxide or a combination of oxides as set forth above, the melting point of the individual materials intended for use herein are generally in excess of 1300° C., and in some instances as high as 2000° C., for example for a material such as $GaO_2$ or $In_2O_3$. Because the arc tubes of interest run at up to about 1500° K., or 1200° C., the coating is in substantially no danger of experiencing degradation due to melting. The melting point of the coating also exceeds the melting point of the PCA envelope, which has an upper limit of about 1900° C.

The coating may include trace amounts of metal in the elemental form as a result of the processing used to deposit the coating. These trace amounts of metal may reflect some radiation back into the lamp, though this reflection will be minimal. The much higher oxide content of the coating, in contrast, dissipates the energy in the form of light emissions.

Yet another advantage of the coating design is the capability of the coating to modify the emissivity of the arc tube by broadening the region of the spectrum at which the lamp emits. This increase in emission capability translates into increased dissipation of heat energy away from the lamp body, i.e. the lamp is rendered radiation dominated, which is very desirable in any lamp application but particularly advantageous for use in lamps that run at very high temperatures. This particular feature further affords an opportunity for production of the lamp in a smaller size. Without this feature, the lamp would fail quickly due to the heat energy that is not efficiently released or radiated away from the lamp, but is instead retained. The advantages described with respect to PCA lamps are equally applicable to visible light-transmissive fused silica and ceramic lamps, which also do not emit light efficiently in the 2 micron region of the spectrum. This aspect of the inventive coating makes it particularly well suited, for example, for stage lighting where there is a constant need for lamps that are bright and provide quality lighting and are available in a reduced size without any attendant loss in performance. In a typical embodiment, this type of lighting is provided in a 320 W lamp. With application of the coating described herein, however, the same size embodiment may be used but with much higher wattage or power capability, in excess of 500 W and up as high as 700 W, with no loss in longevity, due at least in part to the fact that the lamp envelope does not fail even at higher power loading. The increase in power loading may be in the range of 50% or better using the coatings herein.

With respect to the actual coating composition to be used, any oxide may be used. It is preferable to use the oxide as at least 70% of the coating content to assure the desired performance enhancing features described herein, however, lower oxide content may be sufficient depending on the lamp application and desired performance parameters. In addition to metal oxides, other composite materials that are also suitable for use herein include high temperature nitrides and carbides, and even elemental minerals. When minerals are included, during the coating process the minerals tend to bind to the oxide present to form a ternary alloy, such as for example zinc oxide aluminate. The same will occur with other oxide-mineral combinations. This ternary alloy has the advantage that it provides more efficient absorption.

Suitable composites include, but are not limited, to: zinc oxide, aluminum oxide, indium oxide, tin oxide, zirconium oxide, hafnium oxide, tungsten oxide, silicon oxide, zinc nitride, aluminum nitride, indium nitride, tin nitride, zirconium nitride, hafnium nitride, tungsten nitride, silicon nitride, zinc carbide, aluminum carbide, indium carbide, tin carbide, zirconium carbide, hafnium carbide, tungsten carbide, and silicon carbide, among others. The foregoing may be used alone or in combination with one or more additional oxide, carbide or nitride, and may also include one or more elemental metal component as discussed above. For example, the composite may include aluminum, tin, tungsten, zinc, indium, zirconium, chromium, silicon, carbon, lanthanum, strontium, beryllium, hafnium, and their borides, boronitrides, oxynitrides and nitrides, among others.

The coating can be deposited onto the surface of the PCA envelope by any known coating technique, including but not limited to, electron beam deposition, chemical vapor deposition, sputtering, sol-gel and annealing processing, ion implantation and electrochemical oxidation deposition. Generally, the coating is deposited at a thickness of from about 10 nm to about 5,000 nm. Coating thickness should be selected so as not to block visible light emission. However, the coating should be deposited in a layer thick enough to avoid undergoing premature degradation. Preferably, the coating thickness is between 200 nm and 1000 nm. Also, it is important to take into consideration the roughness of the envelope surface when determining the optimum thickness for a deposited coating. Generally, the roughness is referred to as the RMS, or root/mean/square roughness of the substrate, which is usually from about 50 nm to about 5 microns. It is important to assure that the coating thickness is at least as thick as the roughness value, in order to generate a continuous, smooth coating.

As has been stated herein above, when depositing the coating on an envelope surface, the impurities in the oxides of the envelope and the coating materials allow the coating to adhere to the substrate and enhance the stability of the coating with regard to retention on the surface of the PCA envelope. When the coating is applied to a glass or fused silica structure, it may be necessary to first deposit an adhesion layer to assure proper bonding of the coating. One such layer is a chromium oxide layer which can be used when the lamp envelope is fused silica. The adhesion layer, not unlike the coating layer, may be deposited by any known deposition technique.

The following examples are intended to provide those skilled in the art with a better understanding of the invention, and are not intended to be limitative thereof in any manner.

Example 1

Figure 14:
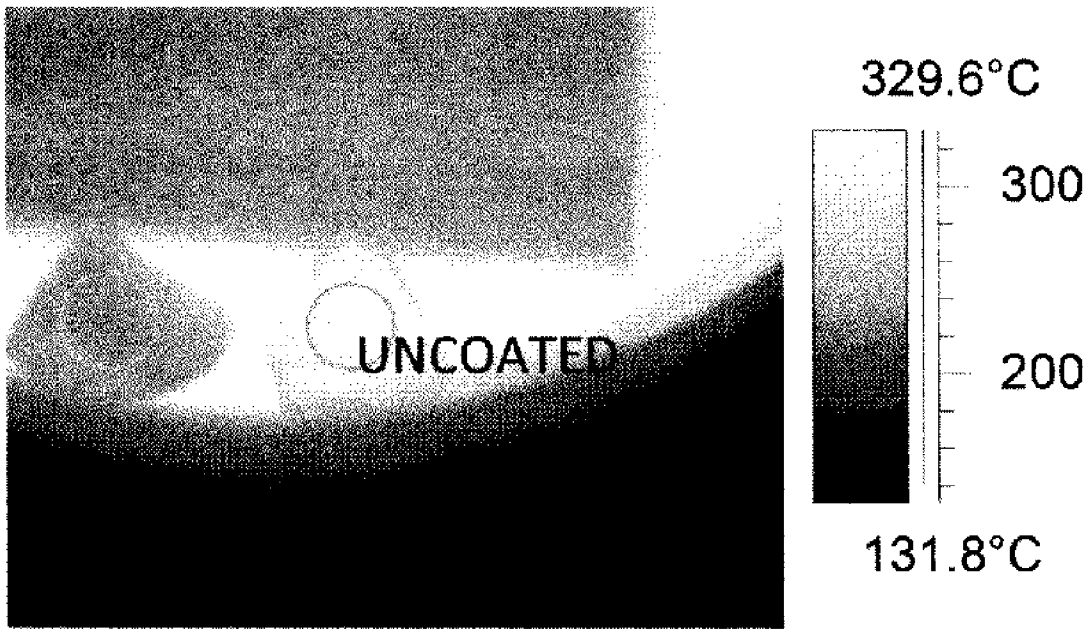
FIG. 14 is an image of the spectral radiation of the two glass slides, one bearing the coating according to the invention and the other uncoated.
Figure 15:
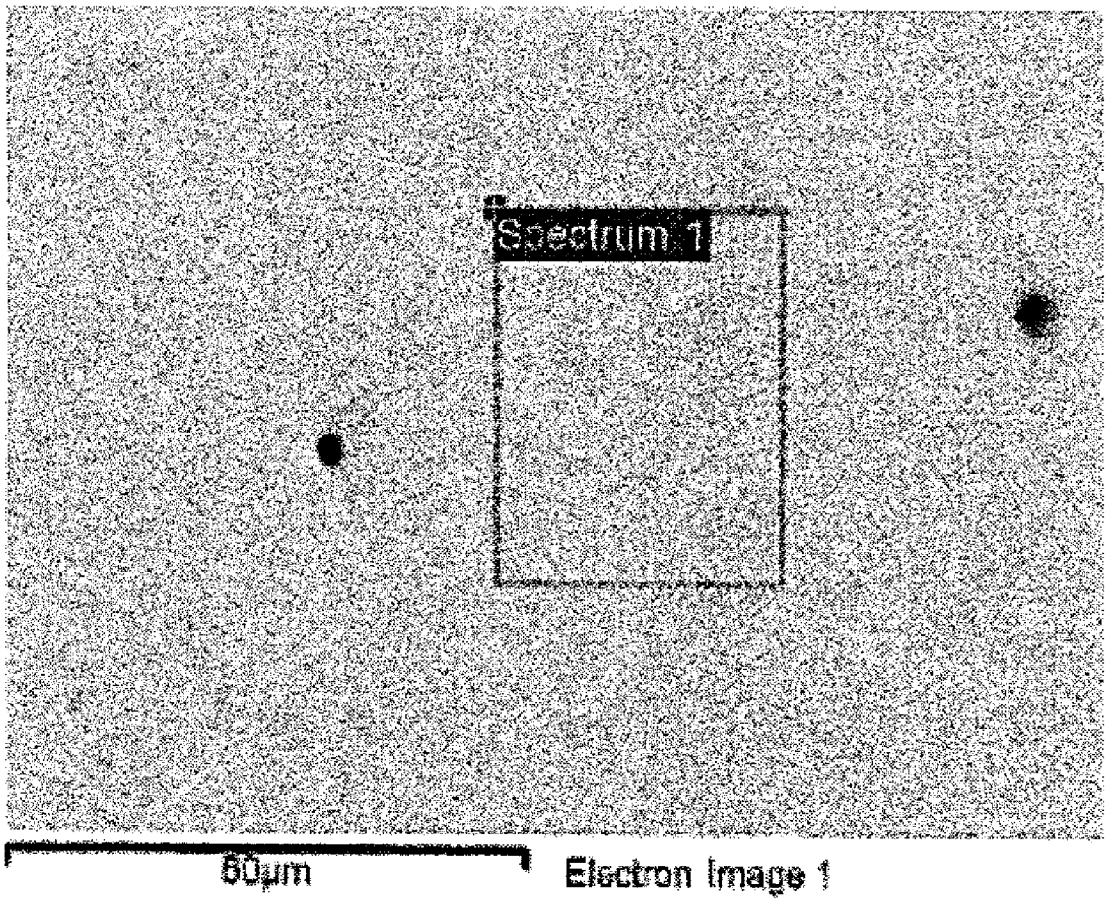
FIG. 15 is a photomicrograph of the surface of the coated slide of FIG. 8.

Identical ceramic glass slides were used for this example. A first slide remained uncoated, while a second ceramic glass slide was coated by sputtering with an indium tin oxide composite containing 80% indium oxide doped with 20% tin. Then it was further oxidized at 500° C. in open air for 30 minutes to form indium tin oxide. The coated slide and the uncoated slide were placed side-by-side in a convection oven to test the infrared radiation emissions from each of the slides under the same operating conditions. FIG. 14 is an image of the spectral radiation of the slides, developed using a 3.1 micron filter. The spectral temperature scale indicates that the coated slide heated only to a temperature of about 250° C., as compared to the uncoated slide which exhibited a temperature of about 320° C. Therefore, the coated slide demonstrated a cooling effect as it radiated a greater amount of heat away from the slide, while the uncoated slide absorbed that same amount of heat. This represents a decrease in heat retention, or a difference in heat dissipation, of about 70° C. between the two slides, which is quite significant. FIG. 15 is a photomicrograph of the surface of the coated slide, which indicates the general uniformity of the coating, having only slight imperfections. The coating can therefore be expected to perform to its optimum performance value.

In keeping with the foregoing, more recent testing involved a glass slide coated with hafnium oxide doped with silicon and carbon. The coated slide exhibited emissivity enhanced by 50% at 1.7 μm, with 90% transmission in the visible spectrum.

Example 2

Figure 16:
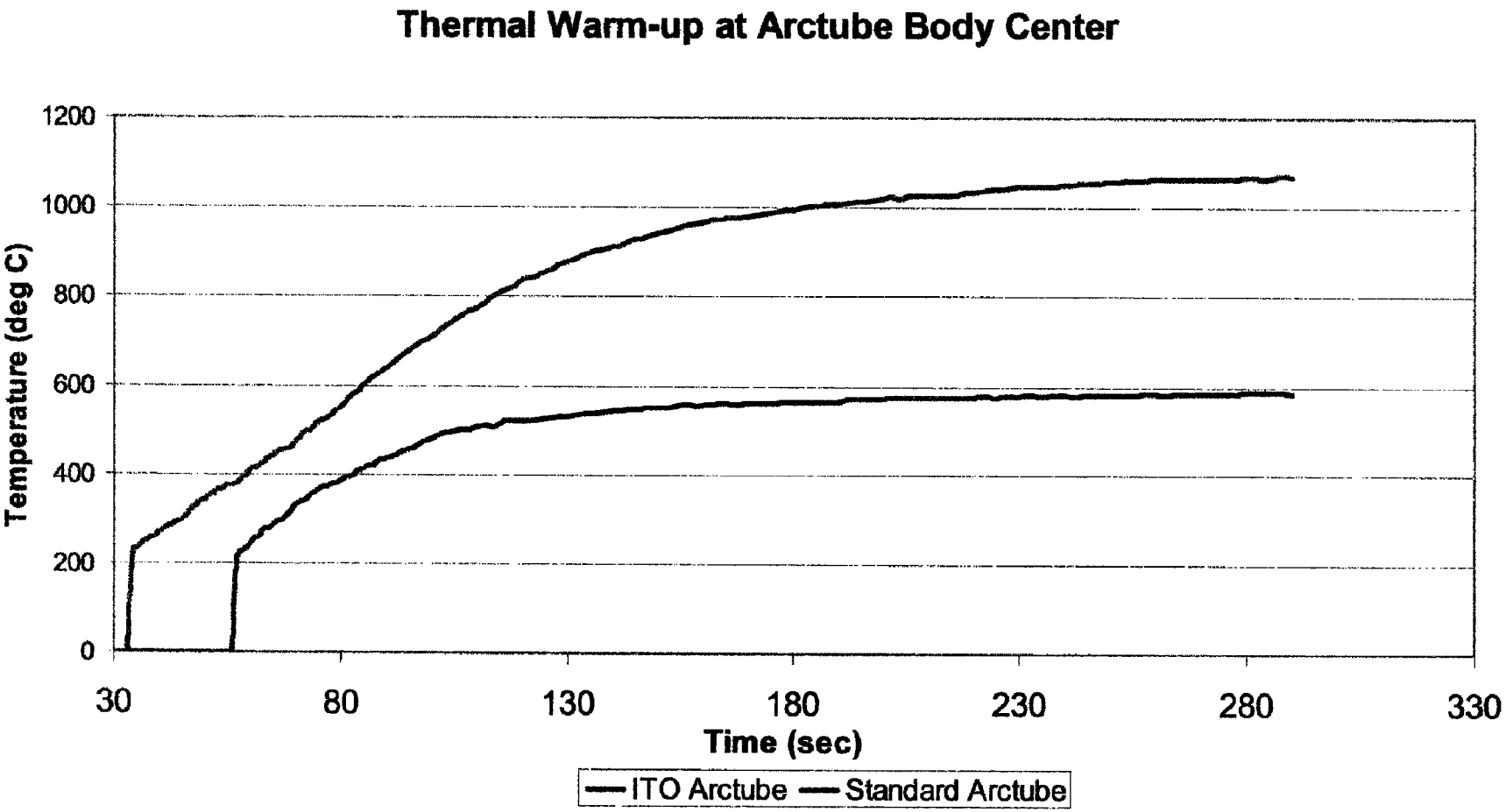
FIG. 16 is a graph showing the increase in temperature, as measured at the arc tube body center, for a coated lamp according to the invention and an uncoated lamp, as a function of time.

Once the foregoing was completed, a coating of the same composition as in the prior Example 1, i.e., indium tin oxide having an indium oxide content of 80%, was prepared as in Example 1 and deposited on the inner surface of an actual ceramic metal halide 150 W lamp available commercially from General Electric. The coating was deposited using a sputtering method. This lamp and an identical lamp that remained uncoated were then subjected to a lamp temperature measurement during lamp operation. The temperature measurement was performed in vacuum using an infrared camera with an 8-12 um filter. FIG. 16 is a graph showing the increase in temperature, as measured at the arc tube body center, for the two lamps as a function of time. The coated lamp ran at least 200° C. lower than the uncoated lamp, indicating that the coating was successfully cooling the lamp as intended.

Example 3

Figure 17:
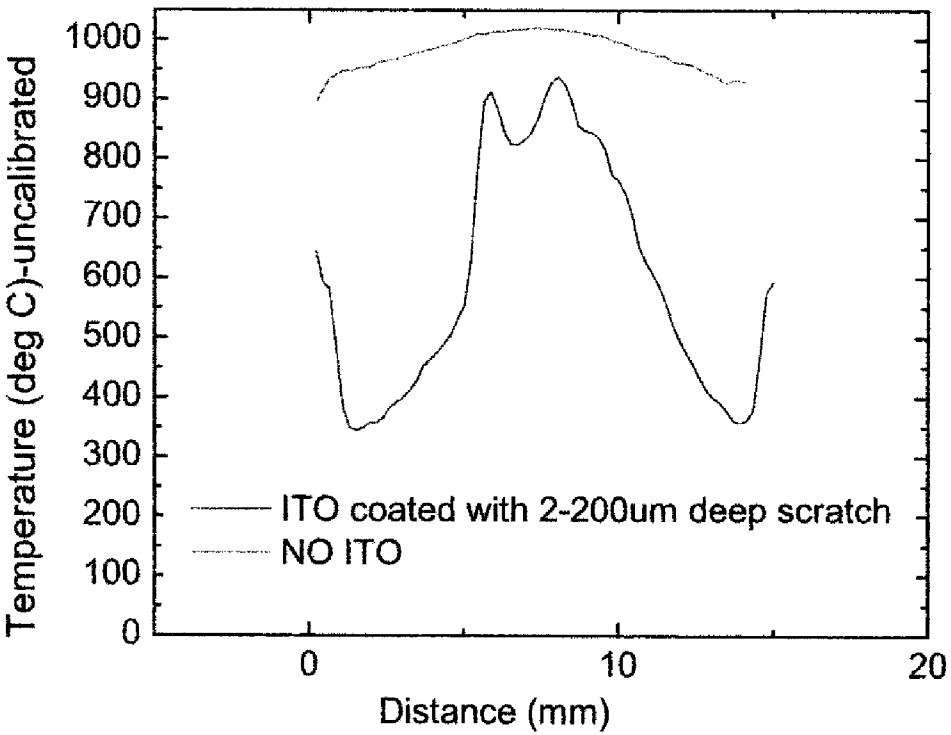
FIG. 17 is a graph of the temperature of an arc tube according to the invention as a function of distance along the arctube, and comparing coated and uncoated portions there.
Figure 18:
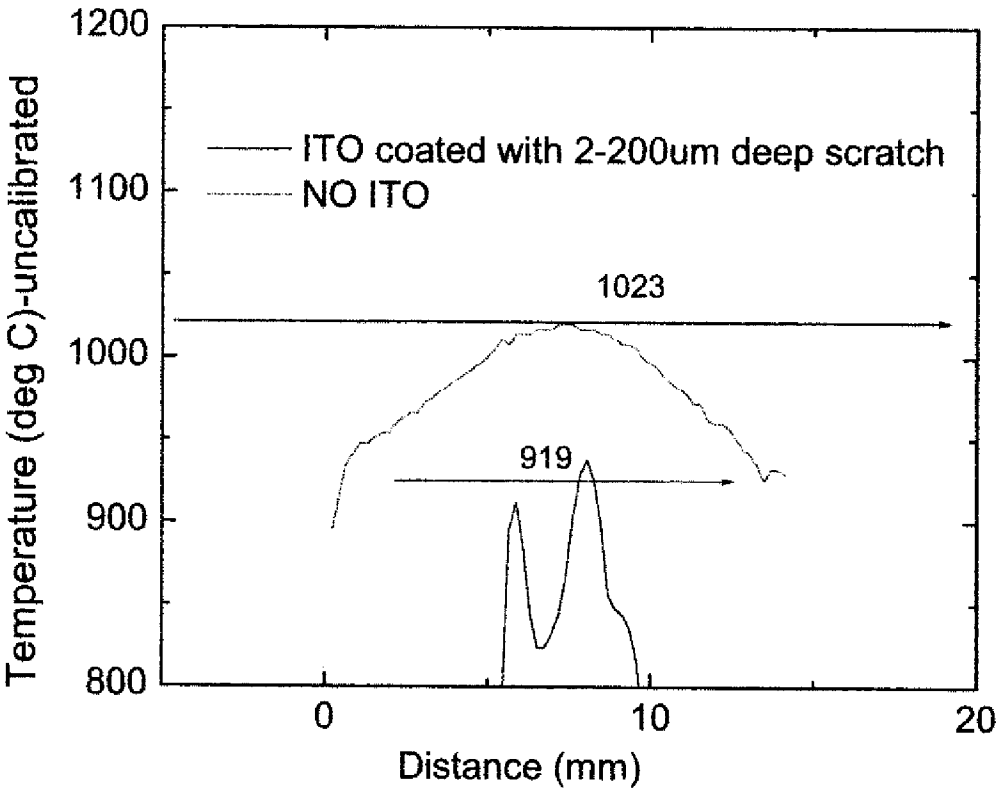
FIG. 18 is an enlargement of a portion of the graph shown in FIG. 17.

To verify the foregoing, the coated lamp from Example 2 was then used for further testing. In this example, the coating on the lamp from Example 2 was scratched to completely remove the coating from a portion of the lamp. The lamp was then subjected to the same test method as used in Example 2 to more accurately determine the effect of the coating. FIG. 17 is a graph of the temperature at the arc tube center of the lamp as a function of time, and comparing the uncoated and coated portions of the lamp. FIG. 18 is an enlargement of the same graph showing just that data for the temperature range between 800-1200° C. As can be seen therein, the coated portion of the lamp exhibited a temperature of at most about 919° C., while the uncoated portion of the same lamp exhibited a temperature of about 1023° C. This corresponds to an actual difference in the same lamp of more than 100° C. In other words, the uncoated portion of the lamp surface absorbed and retained enough heat energy to generate a temperature of 1023° C. The coated portion of the lamp, however, radiated heat away such that it exhibited a temperature over 100° C. cooler than the uncoated portion. Therefore, as is shown above, the coating did in fact render the lamp radiation dominated within the meaning of this disclosure, which will enhance lamp life and performance.

In extended testing of lamps coated according to the invention, the coatings proved to be stable over the extended test period, up to one-hundred (100) hours. In addition, the cooling effect was enhanced over time, likely due to the fact that the coating becomes more compact during extended use. The visible light-transmissive coating herein, therefore, provides an option to decrease lamp size while maintaining wattage, or to maintain lamp size and increase wattage. Of course, there are instances where the need falls somewhere in the middle of these options. These specific application needs are equally achievable using the advance provided herein.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A high intensity lamp comprising a visible-light-transmissive polycrystalline alumina envelope material that is modified by combination of said material with a composite metal oxide coating, source, or dopant, having:

(i) an oxide of at least one of zinc, indium, tin, zirconium, hafnium, tungsten, lanthanum, lutetium, silicon, or other oxide with melting point exceeding about 1300° C.;

(ii) a binary or ternary or high-order alloy of an oxide of (i);

(iii) any of (i) or (ii) doped with one or more of zinc, aluminum, indium, tin, zirconium, hafnium, tungsten, silicon, or other dopant resulting in a composite coating having a melting point exceeding about 1300° C.; or (iv) combinations thereof, wherein said lamp exhibits total hemispherical emittance of greater than 0.20 at 1300° K. due to the void-free and compactness of the coating.

2. The high intensity lamp of claim 1 wherein the lamp envelope material with enhanced IR emittance operates with increased radiation cooling relative to the same lamp envelope in the unmodified state.

3. The high intensity lamp of claim 1 wherein said composite metal oxide comprises a visible-light-transmissive coating that increases the IR emittance of the lamp envelope and causes the lamp envelope to have increased radiation cooling.

4. The high intensity lamp of claim 3 wherein the visible light-transmissive coating comprises at least one layer having a thickness of up to 2μ.

5. The high intensity lamp of claim 1 wherein said visible light-transmissive lamp envelope material is modified by mixing the material with a composite metal oxide source or dopant that increases the IR emittance of the lamp envelope material and causes the lamp envelope material to have increased radiation cooling.

6. The high intensity lamp of claim 5 wherein the modified lamp envelope material further includes a composite metal oxide dopant comprising a material from (iii), with the proviso that the material from (iii) is different from the composite metal oxide source from (i), (ii) or (iv), and is different from the lamp envelope material.

7. The high intensity lamp according to claim 1 where the temperature of the lamp during operation is reduced by at least 50° K. relative to the same lamp in the unmodified state.

8. The high intensity lamp according to claim 1 wherein the lamp, relative to an unmodified lamp operating at the same operational parameters of wattage, voltage, and having the same lamp life, exhibits physical linear dimensions at least 5% smaller, or physical area dimensions at least 10% smaller, than the unmodified lamp.

9. A high intensity lamp comprising a visible-light-transmissive quartz envelope material that is modified by combination of said material with a composite metal oxide coating, source, or dopant, having:

(i) an oxide of at least one of zinc, indium, tin, zirconium, hafnium, tungsten, lanthanum, lutetium, silicon, or other oxide with melting point exceeding about 1300° C.;

(ii) a binary or ternary or high-order alloy of an oxide of (i);

(iii) any of (i) or (ii) doped with one or more of zinc, aluminum, indium, tin, zirconium, hafnium, tungsten, silicon, or other dopant resulting in a composite coating having a melting point exceeding about 1300° C.; or (iv) combinations thereof, wherein said lamp exhibits enhanced IR emittance in the wavelength range where a blackbody operating at the same high temperature exhibits peak emittance and exhibits a total hemispherical emittance of greater than 0.30 at 1300° K., due to the void-free and compactness of the coating.

10. The high intensity lamp of claim 9 wherein the lamp envelope material with enhanced IR emittance operates with increased radiation cooling relative to the same lamp envelope in the unmodified state.

11. The high intensity lamp of claim 9 wherein said composite metal oxide comprises a visible-light-transmissive coating that increases the IR emittance of the lamp envelope and causes the lamp envelope to have increased radiation cooling.

12. The high intensity lamp of claim 11 wherein the visible light-transmissive coating comprises at least one layer having a thickness of up to 2μ.

13. The high intensity lamp of claim 9 wherein said visible light-transmissive lamp envelope material is modified by mixing the material with a composite metal oxide source or dopant that increases the IR emittance of the lamp envelope material and causes the lamp envelope material to have increased radiation cooling.

14. The high intensity lamp of claim 13 wherein the modified lamp envelope material further includes a composite metal oxide dopant comprising a material from (iii), with the proviso that the material from (iii) is different from the composite metal oxide source from (i), (ii) or (iv), and is different from the lamp envelope material.

15. The high intensity lamp according to claim 9 where the temperature of the lamp during operation is reduced by at least 50° K. relative to the same lamp in the unmodified state.

16. The high intensity lamp according to claim 9 wherein the lamp, relative to an unmodified lamp operating at the same operational parameters of wattage, voltage, and having the same lamp life, exhibits physical linear dimensions at least 5% smaller, or physical area dimensions at least 10% smaller, than the unmodified lamp.

* * * * *